US007334420B1

(12) United States Patent
Garris

(10) Patent No.: US 7,334,420 B1
(45) Date of Patent: Feb. 26, 2008

(54) AIR CONDITIONING UNIT INSTALLATION

(76) Inventor: David Garris, 17935 W. Northern Ave., Waddel, AZ (US) 85355

( * ) Notice: Subject to any disclaimer, the term of this patent is extended or adjusted under 35 U.S.C. 154(b) by 293 days.

(21) Appl. No.: 10/863,898

(22) Filed: Jun. 8, 2004

(51) Int. Cl.
*F25D 23/12* (2006.01)

(52) U.S. Cl. ..... 62/259.1; 62/263; 52/199; 454/365

(58) Field of Classification Search ..... 62/259.1, 62/262, 263, 255, 428, DIG. 16; 52/198, 52/199; 236/49.3; 248/237, 241; 454/365
See application file for complete search history.

(56) References Cited

U.S. PATENT DOCUMENTS 3,742,659 A * 7/1973 Drew ..... 52/19
4,403,481 A * 9/1983 Yoho, Sr. ..... 62/259.1
4,483,155 A * 11/1984 Stiles ..... 62/259.1
4,819,448 A * 4/1989 Bardo et al. ..... 62/304
4,895,066 A * 1/1990 Carnahan ..... 454/275
5,454,538 A * 10/1995 Merideth ..... 248/237
5,460,348 A * 10/1995 Cox ..... 248/638
6,354,937 B1 * 3/2002 Crook ..... 454/292
6,715,310 B2 * 4/2004 Kuo ..... 62/262

* cited by examiner

*Primary Examiner*—Mohammad M. Ali
(74) *Attorney, Agent, or Firm*—Parsons & Goltry; Michael W. Goltry; Robert A. Parsons

(57) ABSTRACT

The installation of an air conditioning unit upon a roof having a sloping surface includes providing a framework having a first frame and a second frame which are joined for relative reciprocal movement whereby the framework can be secured to roof and adjusted to provide a horizontal seat for receiving the air conditioning unit thereon. Next provided is a plenum assembly having a first element and second element that are relatively adjustable to be secured to the roof and to the air conditioning unit. Chambers within the plenum assembly conduct air from the air exchange openings in the air conditioning unit to respective openings in the roof defining terminalia of the air conduit system with the respective structure.

35 Claims, 20 Drawing Sheets

AIR CONDITIONING UNIT INSTALLATION

FIELD OF THE INVENTION

The present invention relates to air conditioning units.

More particularly, this invention relates to air conditioning units of the type conventionally mounted upon a roof.

In a further and more specific aspect, the instant invention concerns a support structure for installing an air conditioning unit upon a sloping surface.

BACKGROUND OF THE INVENTION

Typically, air conditioning units employed to provide cooled air, such as refrigeration units and evaporation units, and units employed to provide heated air, such as furnaces or heat pumps, are mounted upon the roof of a structure. It is mandatory that such units be mounted level or horizontal. Predominately, however, the conventional roof has a slope. This is a source of considerable consternation.

In accordance with conventional prior art practice, a first visit must be made to the structure upon which the air conditioning unit is to mounted. During this first expedition, the slope of the roof is determined. Specialized equipment is required to make the determination. Thereafter, a fixed-angle frame is constructed at a remote manufacturing location, as is a fixed-angle plenum. A second visit is then made to the location to install the fixed-angle frame and mount the air conditioning unit. Nevertheless, due to slight sag at various roof locations, fixed-angle frames are often out of level after installation, and fixed-angle plenums often do not fit properly. Existing technology thus requires custom-built fixed-angle frames and fixed-angle plenums, or for those in the industry to have in their inventory a vast variety of different fixed-angle frames and corresponding fixed-angle plenums, which proves frustrating and very expensive.

After the air conditional is installed, it is necessary to connect the air exchange opening in the unit to an air exchange opening in the roof. This is usually accomplished with an accordion pleated duct fabricated of a flexible material. It is noted that the accordion pleats present an internal surface which interferes with the free flow of air between openings. Also, the conditioned air is moderated by the ambient temperature due to the thin wall material of the duct.

Given these and other deficiencies in the art, the need for certain new and useful improvements is evident. There is also a longstanding need in the art to provide a simplified way to install an air conditioning unit and to protect the conditioned air from the ambient environment.

SUMMARY OF THE INVENTION

The above problems and others are at least partially solved and the above objects and others realized in new and improved structure that is simply and conveniently erected for mounting an air conditioning unit upon a sloping surface. In accordance with the principles of the instant invention, provided is an adjustable framework having a platform and adapted to be positioned upon the sloping surface. The framework is then adjusted and secured to define a generally horizontal condition of the platform relative to the sloping surface. Subsequently, the air conditioning unit is placed upon the platform and the air exchange opening in the air conditioning unit is coupled with the air exchange opening in the sloping surface.

In accordance with a further aspect, the adjustable framework comprises a first frame having a seat and a second frame. The second frame is coupled to the first frame for movement between a first position toward the first frame and a second position away from the first frame. The framework is adjusted by moving the second frame away from and toward the first frame. When adjusted, the first frame is secured to the second frame. Preferably, the securement is rigid.

It is within the teachings of the present invention that the first frame be provided with a pivotally attached foot having a sole. A second foot having a sole is pivotally attached to the second frame. When the framework is positioned upon the sloping surface, the first foot and the second foot are pivotally adjusted such that the respective soles are presented against the sloping surface. The first foot and the second foot are then secured to the surface.

It is within the purview of the present invention, that the opening in the air conditioning unit is coupled with the opening in the surface with a plenum assembly concurrently communicating with the opening in the air conditioning unit and the opening in the surface. Preferably, the plenum assembly includes a first rigid plenum element having an attachment end and a second rigid plenum element having an attachment end. The second plenum is coupled to the first plenum element for movement between a first position toward the first plenum element and defining a retracted condition of the plenum assembly and a second position away from the first plenum element and defining an expanded condition of the plenum assembly.

The plenum assembly is adjusted between the retracted and expanded conditions so as to place the plenum assembly in an adjusted condition wherein the attachment ends of the first and second plenum elements are positioned concurrently against the air conditioning unit and the surface, respectively, so as to engulf the openings therein. In the adjusted condition, the first rigid plenum element is rigidly secured to the second rigid plenum element thereby forming an adjusted plenum assembly.

In accordance with the teachings of the instant invention, the plenum assembly includes an internal insulating flap. The flap includes an end attached to one of the plenum elements and an opposing free end. After the plenum assembly is adjusted, the free end is secured within the other of the plenum elements.

BRIEF DESCRIPTION OF THE DRAWINGS

The objects and advantages of the present invention will become readily apparent to those skilled in the art from the following detailed description of preferred embodiments thereof, taken in conjunction with the drawings, in which.

DETAILED DESCRIPTION OF PREFERRED EMBODIMENTS

Figure 1:
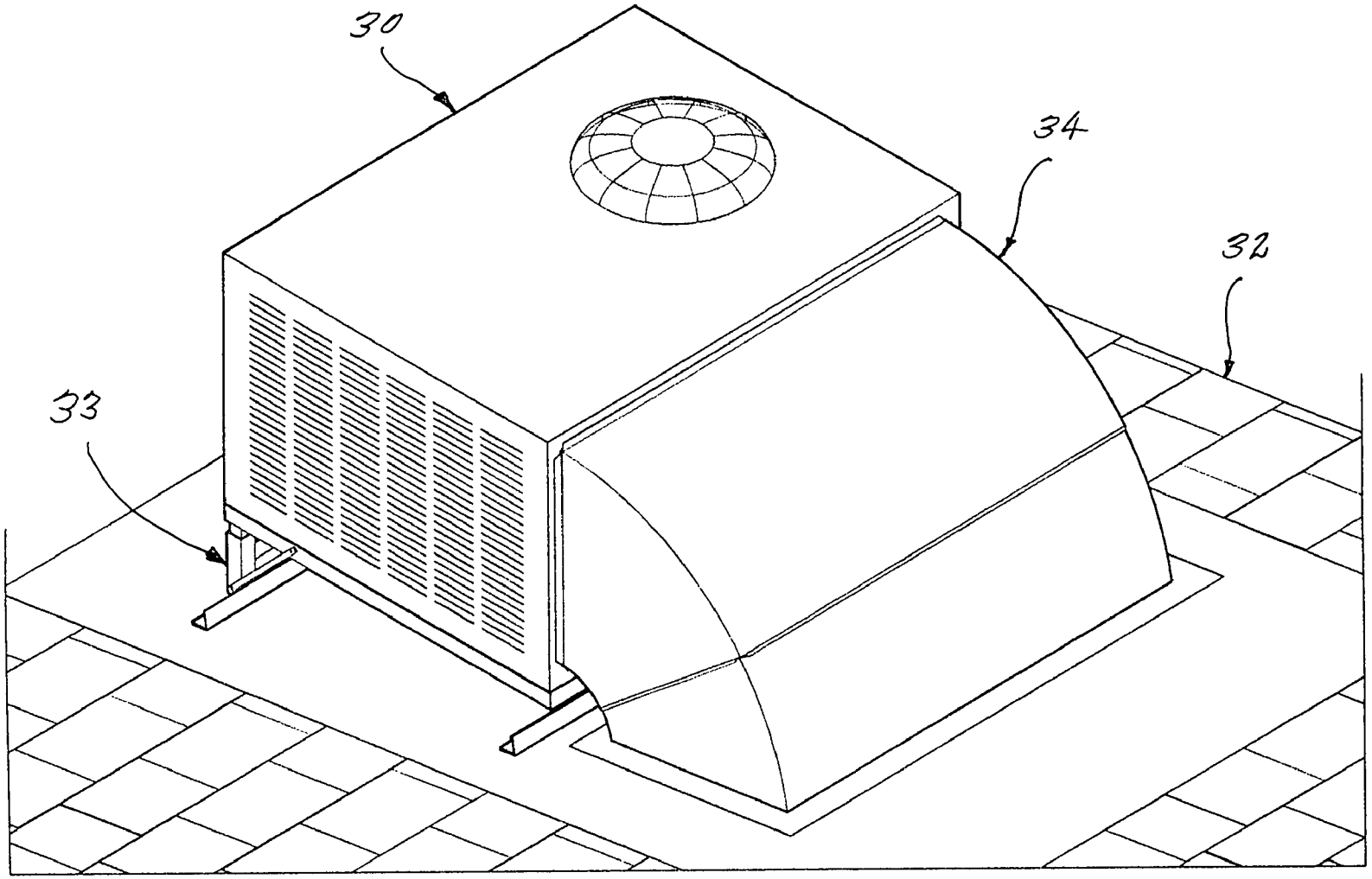
FIG. 1 is a perspective view of a conventional air conditioning unit installed in accordance with the teachings of the present invention.

Turning now to the drawings, in which like reference characters designate like elements throughout the several views, attention is first directed to FIG. 1 in which is seen an air conditioning unit, generally designated by the reference character 30 as it would appear when installed upon roof 32. The installation is facilitated by method and apparatus in accordance with the principles of the instant invention including a framework, generally designated by the reference character 33, and a plenum, generally designated by the reference character 34.

Figure 2:
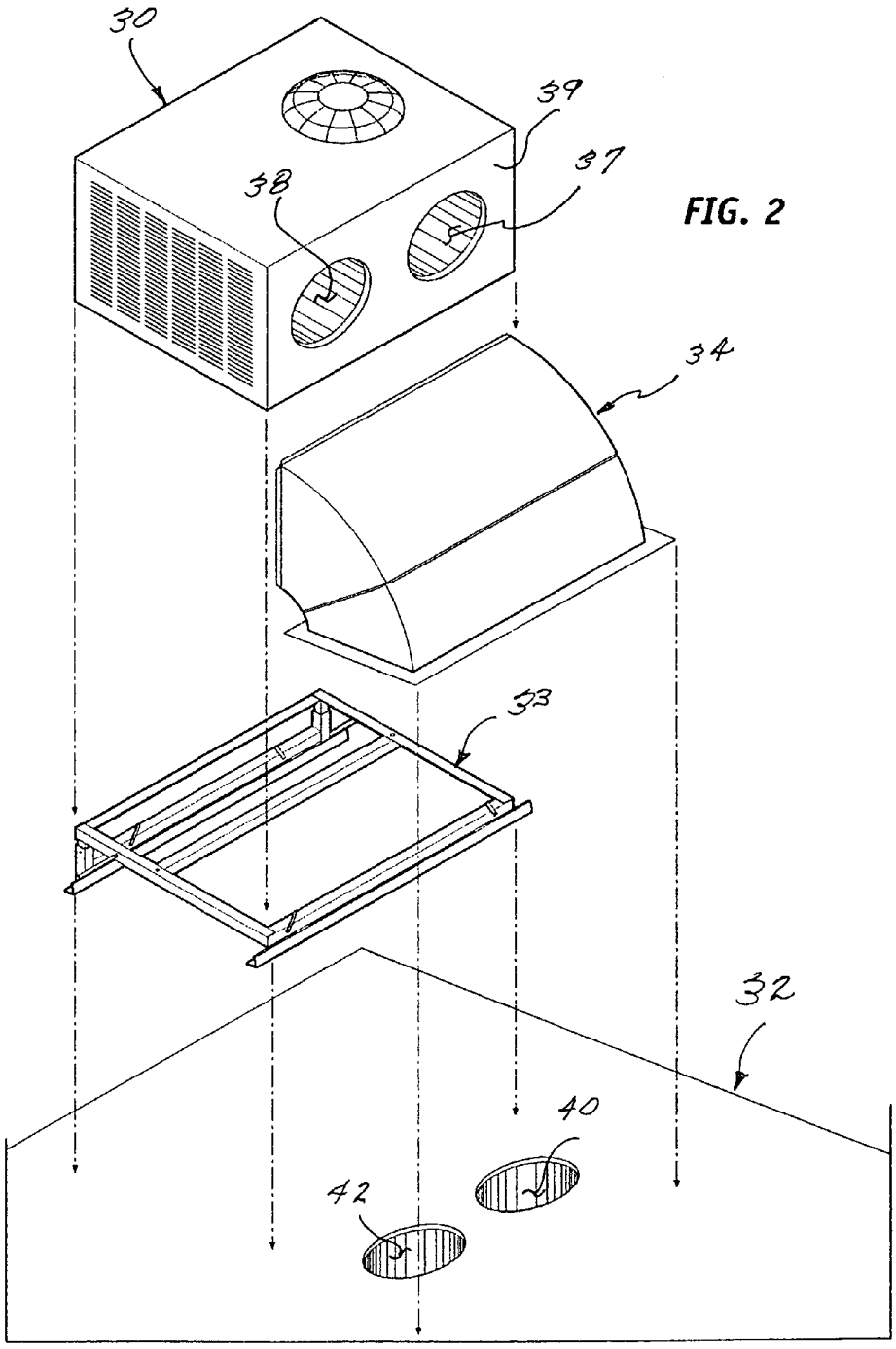
FIG. 2 is an exploded perspective view.

Air conditioning unit 30, as seen in further detail in FIG. 2, includes housing 35, air exchange outlet opening 37 through which conditioned air is discharged and air exchange inlet opening 38 for receiving circulated air. Openings 37 and 38 are located in upstanding sidewall 39. Accordingly, air conditioning unit 30 is commonly referred to as a "side draft" unit. Air conditioning unit 30 is intended to be generally representative of conventional, commercially available units that treat air by refrigeration, evaporation, heating or other means. Further features and details of such units, not herein specifically illustrated nor described will be readily appreciated by those skilled in the art.

With additional reference to FIG. 2, there is seen an air exchange inlet opening 40 and an air exchange outlet opening 42 in roof 32. As will be further appreciated by those skilled in the art, openings 40 and 42 represent the terminalia of the duct and vent system employed to condition the ambient air within the respective dwelling. The openings 37 and 38 in air conditioning unit communicate with openings 40 and 42, respectively, in roof 32 through plenum 34. The structure and function of plenum 34 will be illustrated and described presently in further detail.

Figure 6:
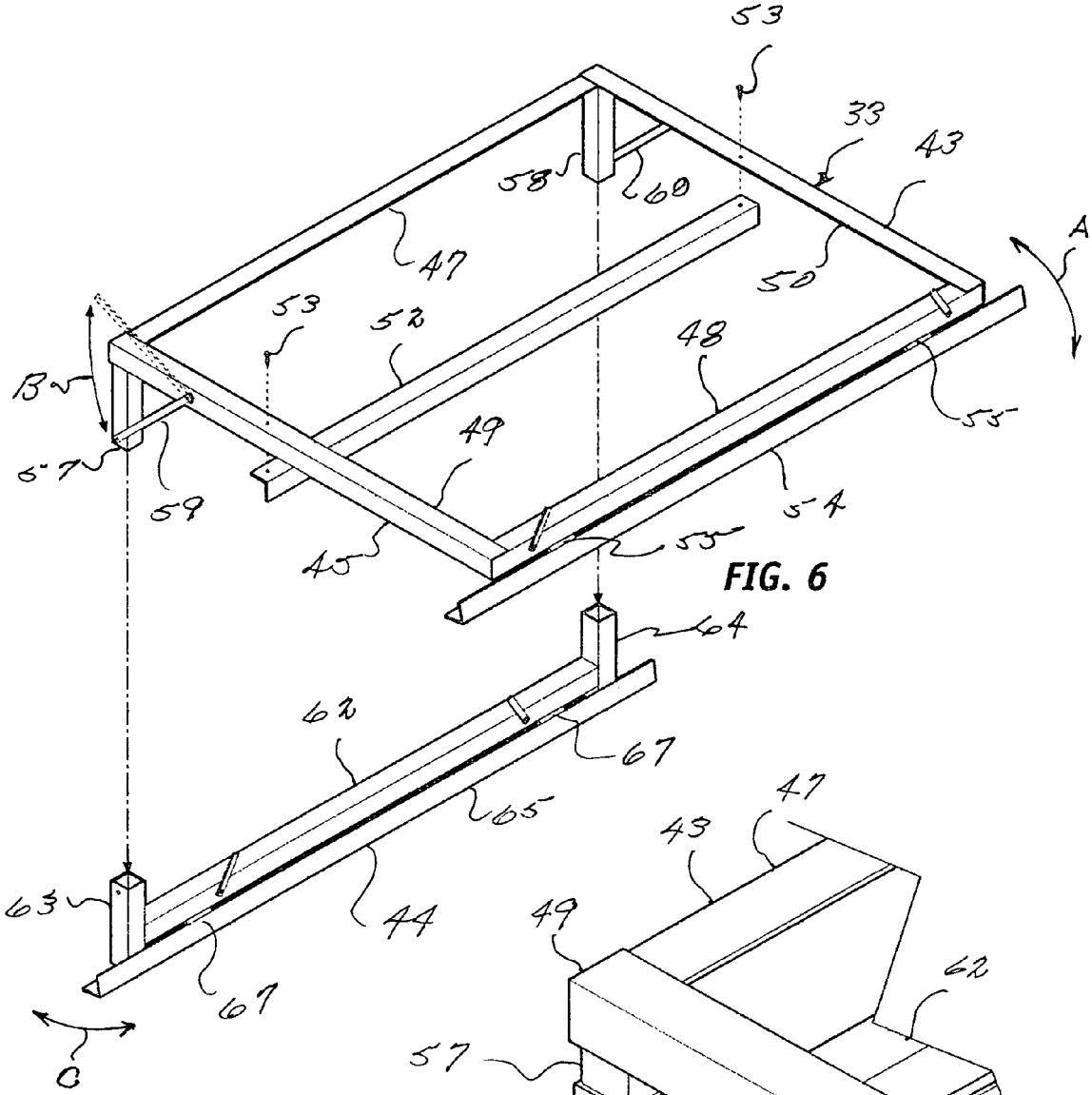
FIG. 6 is an enlarged, partially exploded perspective view of the framework seen in FIG. 1.
Figure 7:
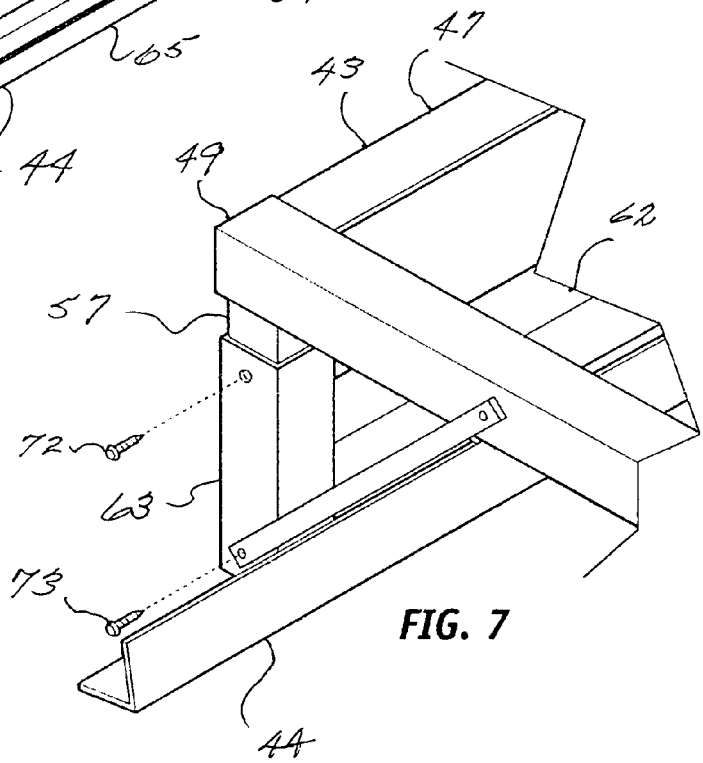
FIG. 7 is an enlarged view of a section of the framework seen in FIG. 6.

Framework 33 will now be described in detail with reference to FIGS. 6, 7 and 8. As especially illustrated in FIG. 6, framework 33 comprises a first frame 43 and a second frame 44. First frame 43 includes a generally rectangular component 45 having spaced apart, elongate longitudinal members 47 and 48 and spaced apart, elongate lateral members 49 and 50. Preferably, the several members are fabricated of metal, such as angle iron or aluminum, and joined at the respective corners by mechanical fastening means such as welding, screws or rivets.

Reinforcement member 52 is secured to lateral members 49 and 50 at an intermediate location as by screws 53. Foot 54 is secured to longitudinal member 48 by hinges 55 for relative reciprocal movement as indicated by the double arrowed, arcuate line A. Preferably, foot 54 is fabricated of angle iron and extends outboard of either end of member 48.

Leg 57 depends from rectangular component 45 proximate the intersection of longitudinal member 47 and lateral member 49. Similarly, leg 58 depends from rectangular component 45 proximate the intersection of longitudinal member 47 and lateral member 50. Preferably, legs 57 and 58 are fabricated of square tubing and are rigidly affixed to rectangular component 45. Also carried by rectangular component 47 are struts 59 and 60 which are movable as indicated by the double arrowed, arcuate line B. Further description of struts 59 and 60 will be made presently.

Second frame 44 includes elongate member 62 having upstanding legs 63 and 64 secured to respective ends thereof. Upstanding legs 63 and 64, preferably fabricated of square tubing, are spaced and sized to receive depending legs 67 and 68, respectively, for relative reciprocal movement. Second frame 62 also includes elongate foot 65, preferably fabricated of angle iron. The structure formed by member 62 and legs 63 and 64 is affixed to foot 65 by means of hinges 67 for relative reciprocal movement as indicated by the double arrowed, arcuate line C. It is noted that foot 65 is of sufficient length to extend outboard at each end of the structure formed by member 62 and legs 63 and 64.

Figure 8:
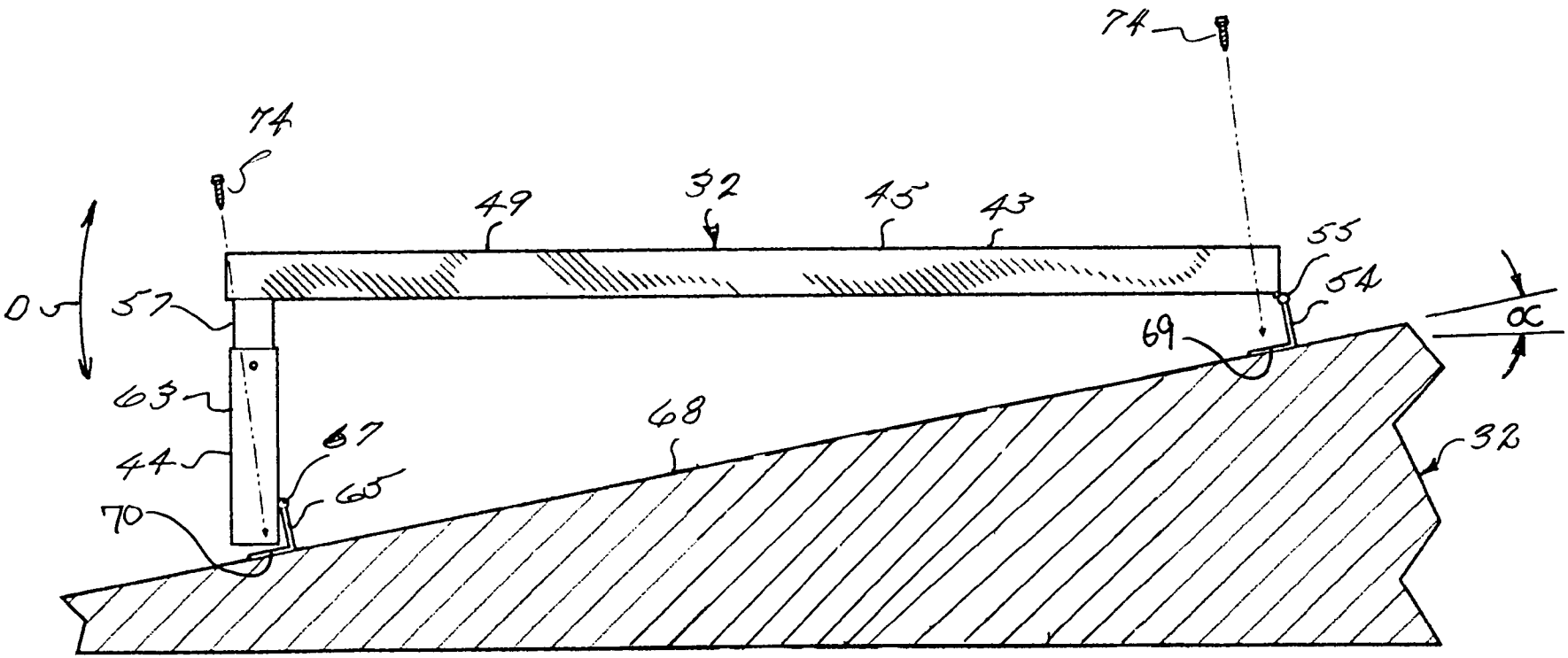
FIG. 8 is an enlarged, vertical side view of the framework seen in FIG. 1.

For purposes of reference, attention is now directed to FIG. 8 wherein it is observed that roof 32 includes surface 68 which has a slope, also referred to as a pitch, as denoted by the angle $\alpha$. Typically, angle $\alpha$ is in the range of one to six inches drop per twelve inches.

With additional reference to FIG. 8, it is seen that foot 54 carries and undersurface or sole 69 which is received in juxtaposition with surface 68. Similarly, foot 65 includes sole 70 which rests in juxtaposition with surface 68. With soles 69 and 70 in full contact with surface 68, first frame 43 is reciprocally movable relative surface 68 as indicated by the double arrowed, arcuate line D. Accordingly, first frame 43 can be adjusted relative second frame 44 to accommodate angle $\alpha$ and placed horizontally. To initially retain framework 33 in the adjusted position, a screw, as seen in FIG. 7 is employed to locationally secure depending leg 57 within upright leg 63. Similarly, although not specifically illustrated, it will be appreciated that depending leg 50 is similarly secured to upright leg 64. For additional strength and rigidity, the free end of strut 59 is secured to upstanding leg 63 as by screw 73.

Framework can be readily set to the adjusted position, that is, with first frame in the horizontal position, upon the roof with a conventional carpenters level. It is also within the scope of invention that angle $\alpha$ be determined and the framework 33 set to the adjusted position prior to placement upon the surface 68. After the framework 33 is adjusted and positioned upon sloping surface 68, screws 74, as specifically seen in FIG. 8, are passed through the outboard sections of foot 54 and foot 65 and engaged within roof 32 for final positioning of framework 33.

Plenum assembly 34 will now be described in detail with reference to FIGS. 3, 4, 5, 9, 10 and 15. Referring first to FIG. 5 is noted that plenum assembly 34 includes first plenum element 75 and second plenum element 77. The plenum elements 75 and 77 are generally in the shape of sectors of a hollow cylinder. Accordingly, element 75 includes outer generally cylindrical panel 78, inner generally cylindrical panel 79 and end panels 80 and 82. Similarly, second element 77 includes outer substantially cylindrical panel 83, inner substantially cylindrical panel 84 and end panels 85 and 87. As seen with additional reference to FIG. 15, second plenum element 77 also includes an intermediate panel 88 which is substantially parallel to end panels 85 and 87. First plenum element 77 includes two spaced apart intermediate panels 89 and 90 which are substantially parallel to end panels 80 and 82.

Preferably, the plenum elements 75 and 77 are fabricated of sheet metal. Outwardly directed parametric flanges 92 and 93 carried at respective upper and lower longitudinal edges of first plenum element 75 provide rigidity to the structure. Similarly, outwardly directed parametric flange 94 provides rigidity to the lower longitudinal edge of second plenum element 77. Panel 95, having openings 97 and 98 therein resides within second plenum element in the plane of flange 94. For purposes of reference, second plenum element 77 also includes an upper longitudinal edge 99.

Figure 4:
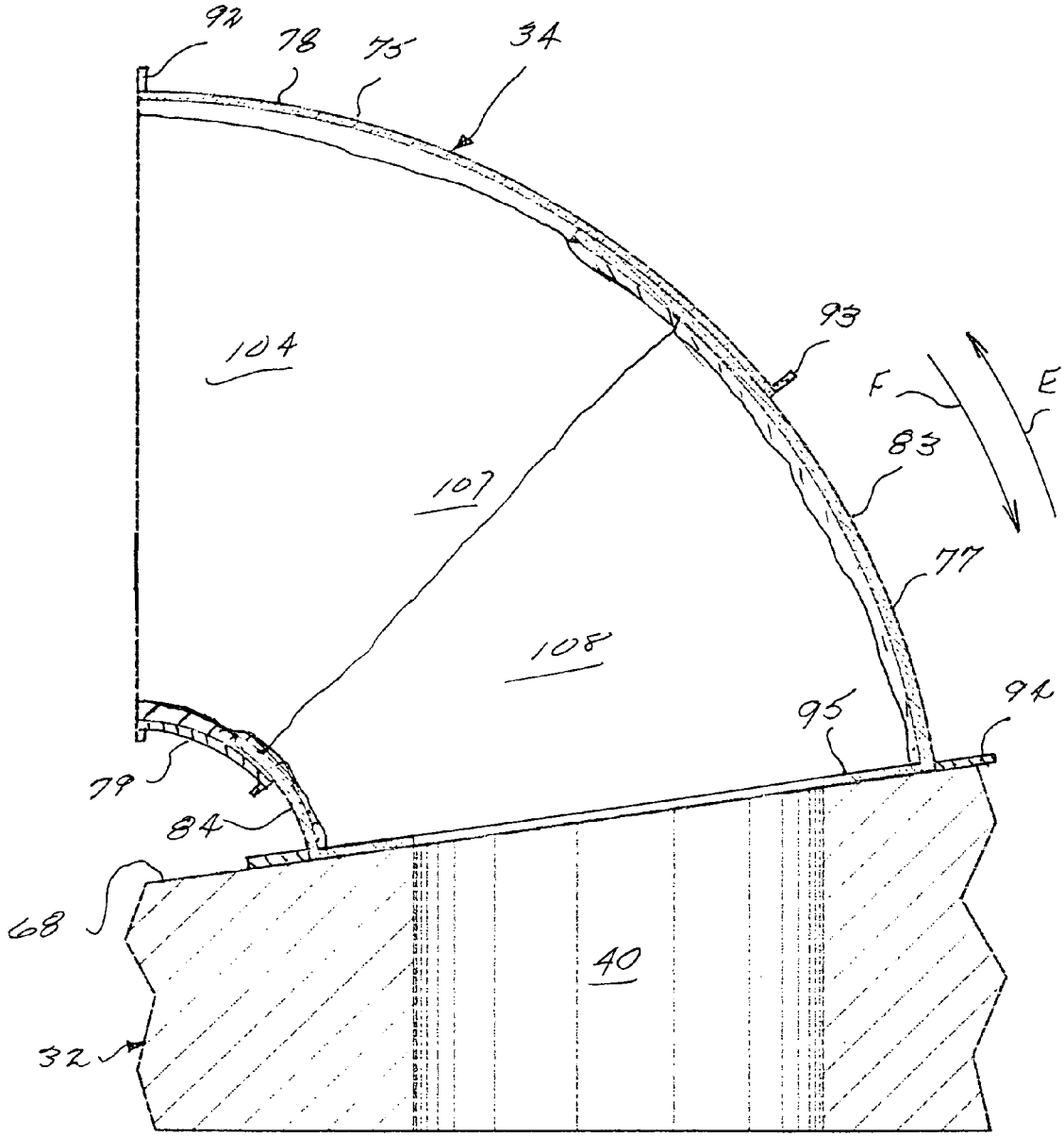
FIG. 4 is a vertical sectional view taken along the line 4-4 in FIG. 3.
Figure 5:
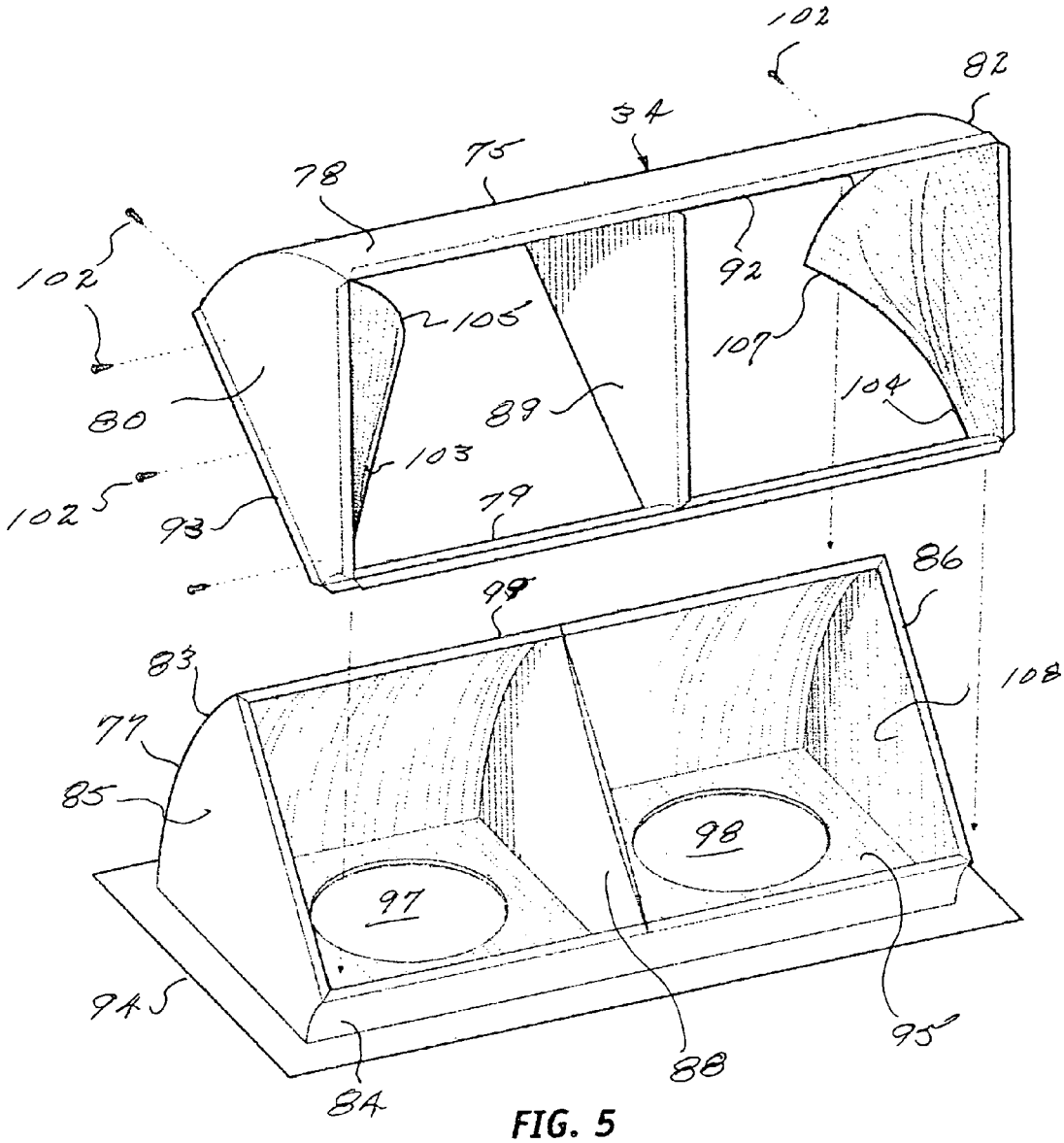
FIG. 5 is an enlarged, exploded perspective view of the plenum seen in FIG. 1.

Second plenum element 77, as especially illustrated in FIG. 4, is closely received within first plenum element 75 for relative reciprocal movement in directions indicated by the arcuate arrowed lines E and F. Movement of second plenum element 77 in the direction indicated by the arrowed line E results in a terminal first position defined as the retracted condition of plenum assembly 34. Movement of second plenum element 77 in the opposite direction, as indicated by the arrowed line F, terminates with the second plenum being in a second position and the plenum assembly 34 being in an expanded condition.

Figure 3:
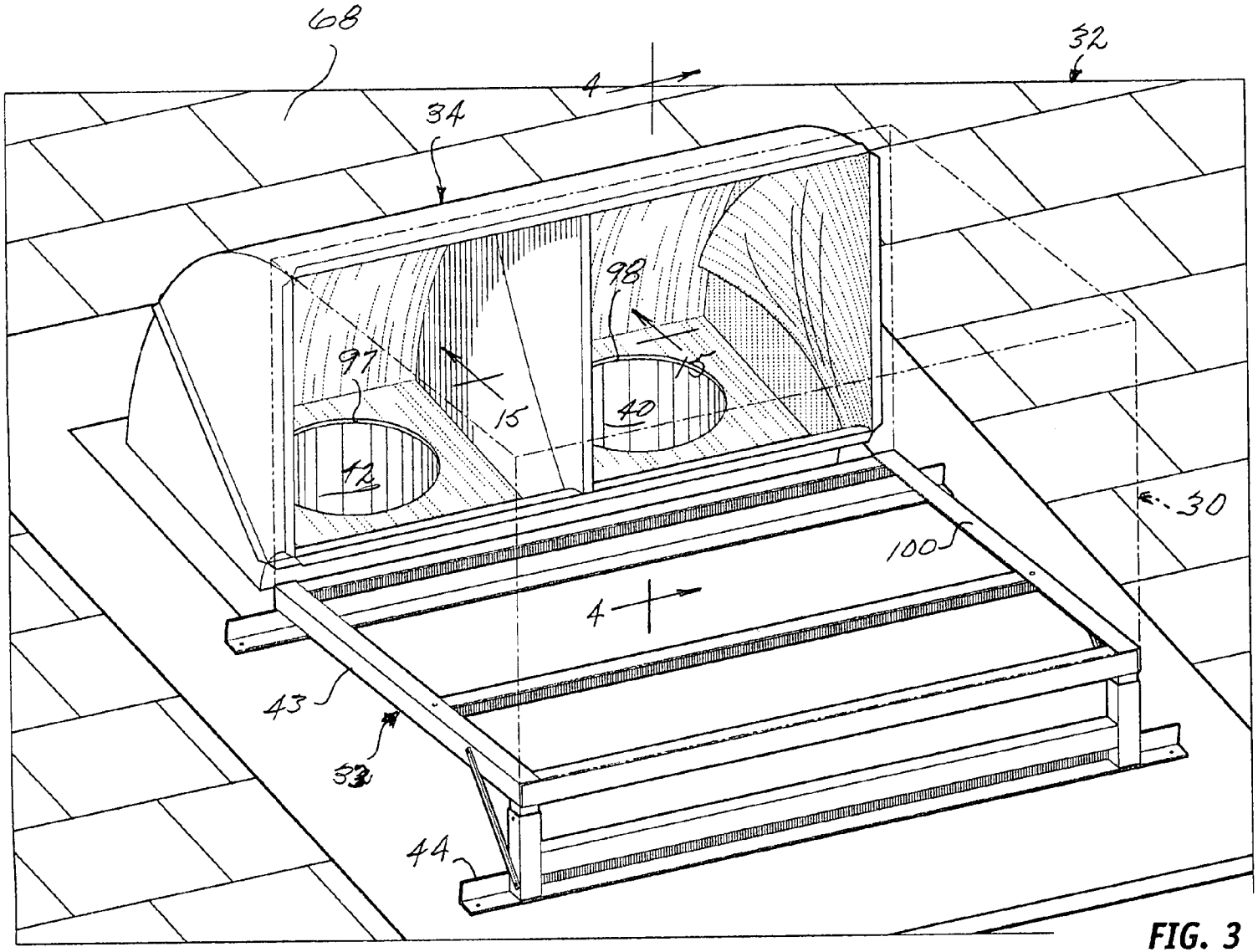
FIG. 3 is a view generally similar to the view of FIG. 1 and having the air conditioning unit removed for purposes of illustration.

After placement of the adjusted framework 33 upon sloping surface 68, as illustrated in FIG. 3, the installation procedure continues with the placement of air conditioning unit 30 upon framework 33, the upper surface 100 of first frame 43 functioning as a seat for receiving air conditioning 30 thereon and for holding air conditioning unit 30 in horizontal alignment. For purposes of reference, air conditioning unit 30 is illustrated in broken outline.

Subsequently, plenum assembly 34 is positioned upon surface 68 with the openings 97 and 98 in alignment with the openings 42 and 40, respectively, in sloping surface 68. First plenum element 75 is then moved relative second plenum element 77, as necessary in directions designated by the arcuate arrowed lines E and F to achieve an adjusted condition in which flange 92 is received in juxtaposition with sidewall 39 of air conditioning unit 30 and openings 38 and 39 in sidewall 39 of air conditioning unit 30 are engulfed within first plenum element 75. The plenum elements 75 and 77 are then retained in the adjusted condition as by sheet metal screws 102 as seen in FIG. 5.

The plenum assembly 34, now secured in the adjusted condition, is temporarily removed for the purpose of insulating the interior. Preferably, sheets or panels of insulation material, commonly referred to as duct lining, are adhesively secured to the interior surfaces of each of the several exterior panels of first plenum element 75 and second plenum element 77. With reference to FIGS. 4 and 5, it is noted that the insulation end panels 103 and 104 carried on the internal surfaces of end panels 82 and 82 of first plenum element 75 are extended to provide flaps 105 and 107, respectively. After the plenum assembly is adjusted to the adjusted condition the flap 107 is overlayed and secured to insulation panel 108 carried within second plenum element 77. Although not specifically illustrated, it is understood that the entire interior of the plenum assembly 34 is similarly coated with insulation material. It is within the purview of the instant invention that other techniques be employed to insulate the interior of plenum assembly 34 such as coatings applied by brush or spray.

Figure 9:
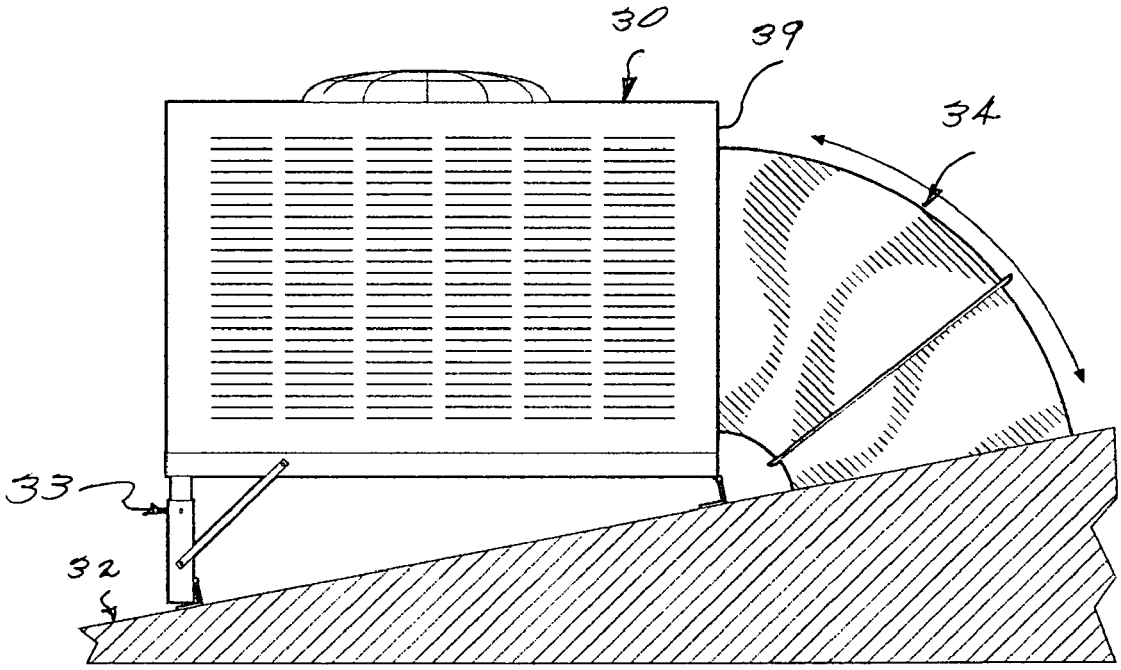
FIG. 9 is a vertical side view of the assembly seen in FIG. 1.
Figure 10:
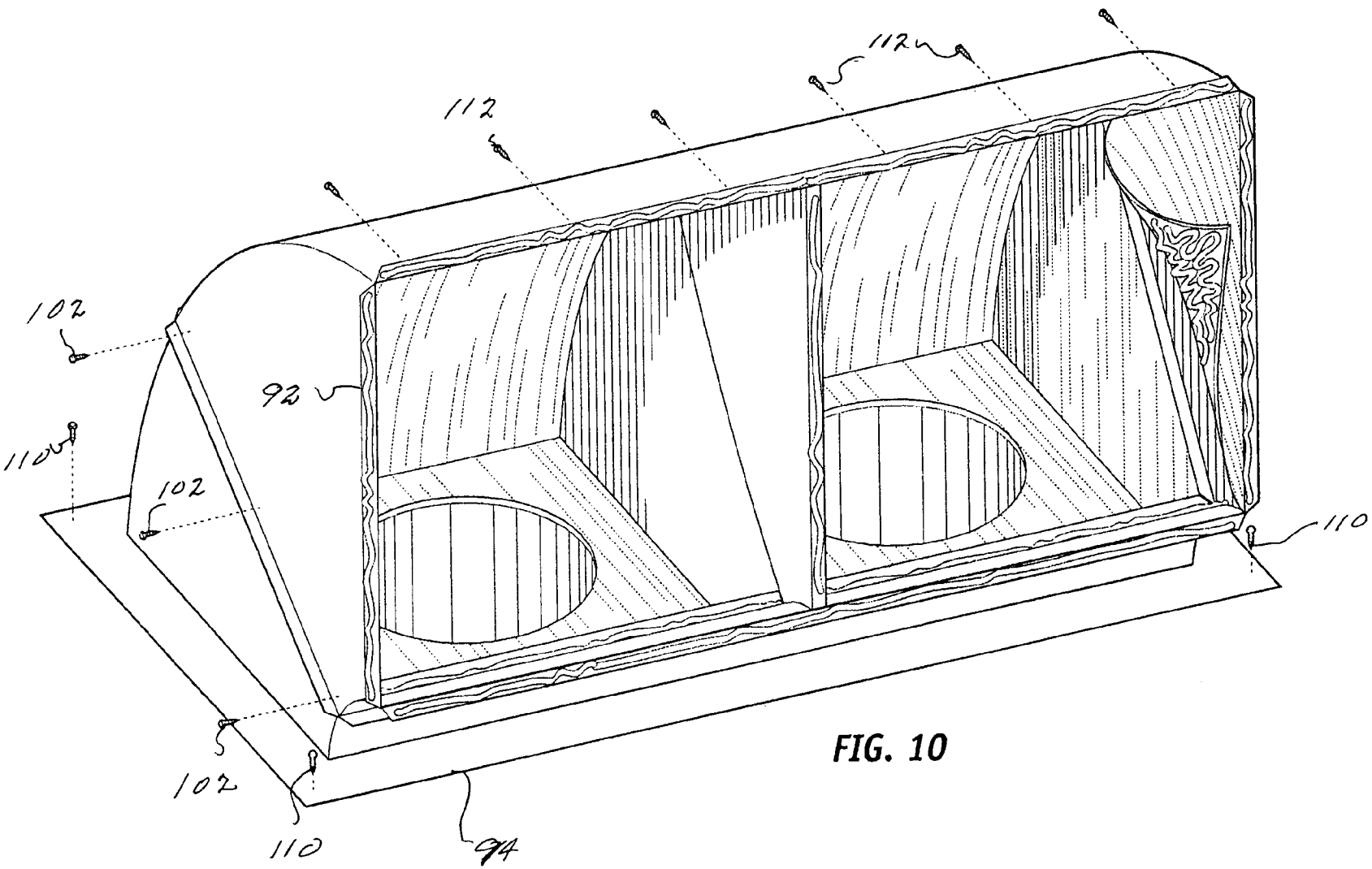
FIG. 10 is a perspective view generally similar to the view of FIG. 5 and illustrating the plenum in the adjusted condition prior to final installation.

After plenum assembly is prepared as above, a sealant 109, such as latex or silicone, is applied to the outer surface of flange 92 and the underside surface of flange 94 as illustrated in FIG. 10. Plenum assembly 34, as shown in FIG. 9, is then repositioned, the sealant 109 being pressed against the surface 68 of roof 32 and against the sidewall 39 of air conditioning unit 30, thereby insuring an air tight passage for the inflow and outflow of air. Screws 110 are employed to secure flange 94 to surface 68. Similarly, screws 112 secure flange 92 to sidewall 39.

Figure 11:
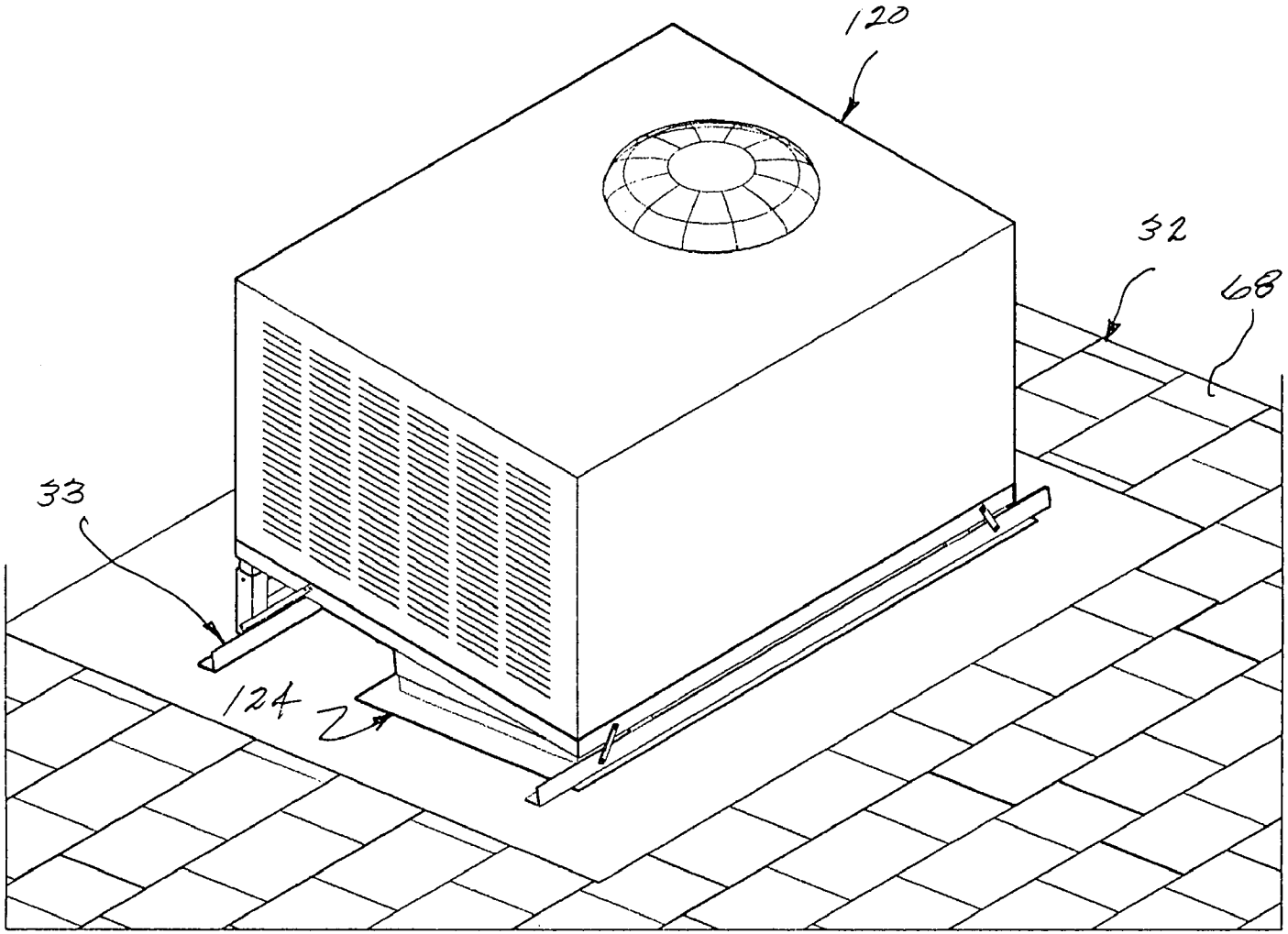
FIG. 11 is a perspective view of another conventional air conditioning unit as it would appear when installed in accordance with an alternate embodiment of this invention.
Figure 12:
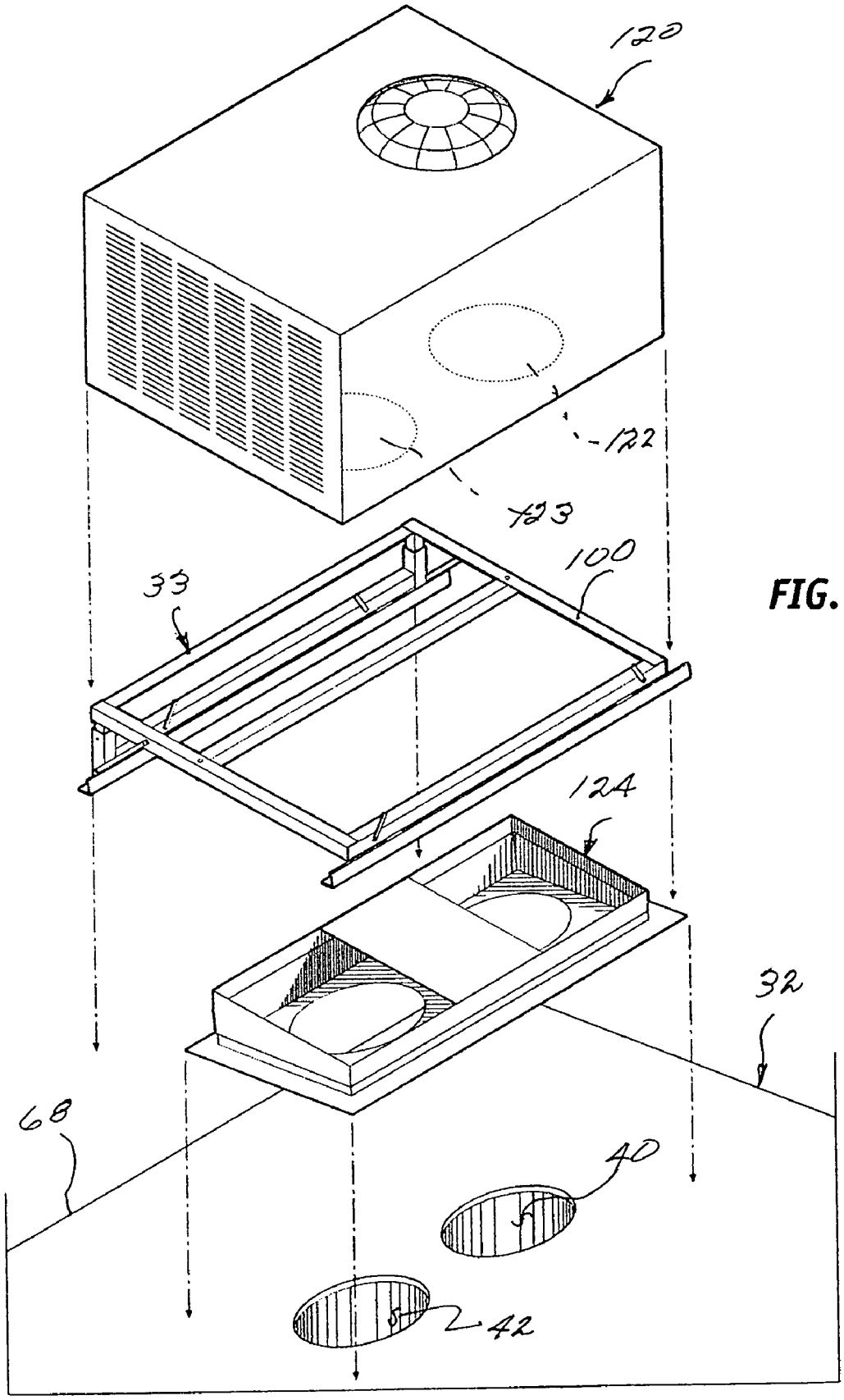
FIG. 12 is an exploded perspective view of the embodiment of FIG. 11.

Referring now to FIGS. 11 and 12, there is illustrated an alternate air conditioning unit 120 having air exchange opening 122 and air exchange opening 123 on the under surface thereof. Such units are commercially available and generally referred to as "down draft." In all other aspects, air conditioning unit 120 is similar to previously described air conditioning unit 30.

The installation of air conditioning unit 120 is generally similar to the installation of air conditioning unit 30. Initially, framework 33 is adjusted to provide a horizontal seat 100 for receiving air conditioning unit 120 thereon. Framework 33 is then secured to surface 68 of roof 32 over openings 40 and 42. Subsequently air conditioning unit 120 is positioned upon framework 32.

Figure 13:
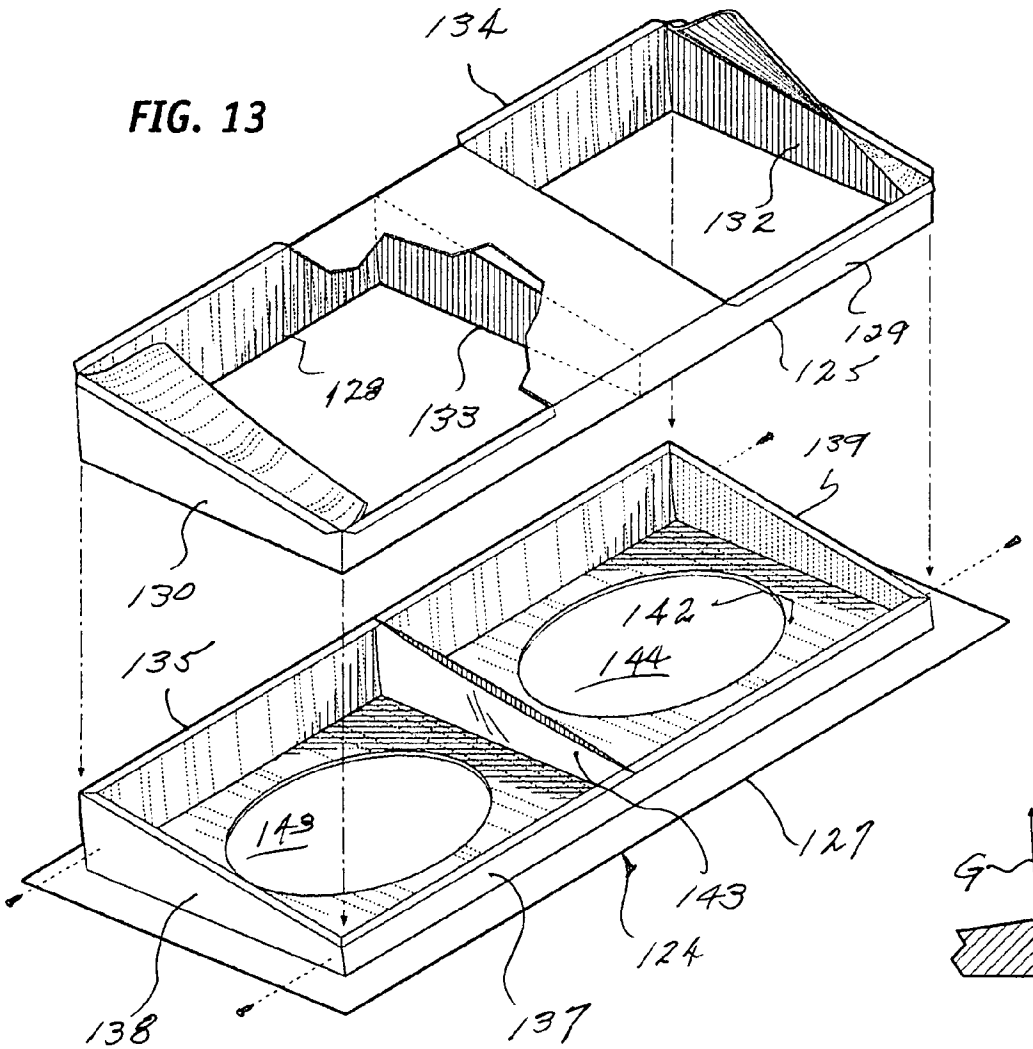
FIG. 13 is an exploded perspective view of the plenum seen in FIG. 12.
Figure 14:
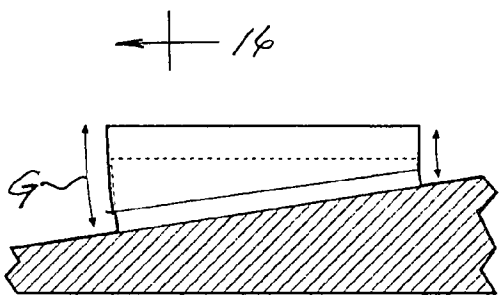
FIG. 14 is a side elevational view of the assembled plenum depicted in FIG. 13.

Referring now to FIGS. 13 and 14, there is seen a plenum assembly, generally designated by the reference character 124, especially devised to be installed intermediate air conditioning unit 120 and surface 68 of roof 32. In general similarity to previously described plenum assembly 34, plenum assembly 124 comprises first plenum element 125 and second plenum element 127 which when coupled have a shape generally similar to a segment of a hallow cylinder.

First plenum element 125 includes outer panel 128, inner panel 129, first end panel 130 and second end panel 132. Outer panel 128 and inner panel 129 are generally arcuate in cross section. End panels 130 and 132 are generally planer. Panel 133 resides intermediate panels 130 and 132 and is generally horizontal thereto. Outwardly directed parametric flange 134 extends about the upper edge of plenum element 125.

Second plenum element 127, sized to be received within first plenum element 125, as especially noted in FIG. 14, includes outer panel 135, inner panel 137, first end panel 138 and second end panel 139. Parametric flange 140 extends outwardly form the lower edge of plenum element 127. Further included is a bottom panel 142 having openings 143 and 144 which, when element 127 is position upon roof 32, align with openings 42 and 40, respectively. Intermediate panel 143 extends upwardly form bottom panel 142 and is parallel to end panels 138 and 139.

Figure 15:
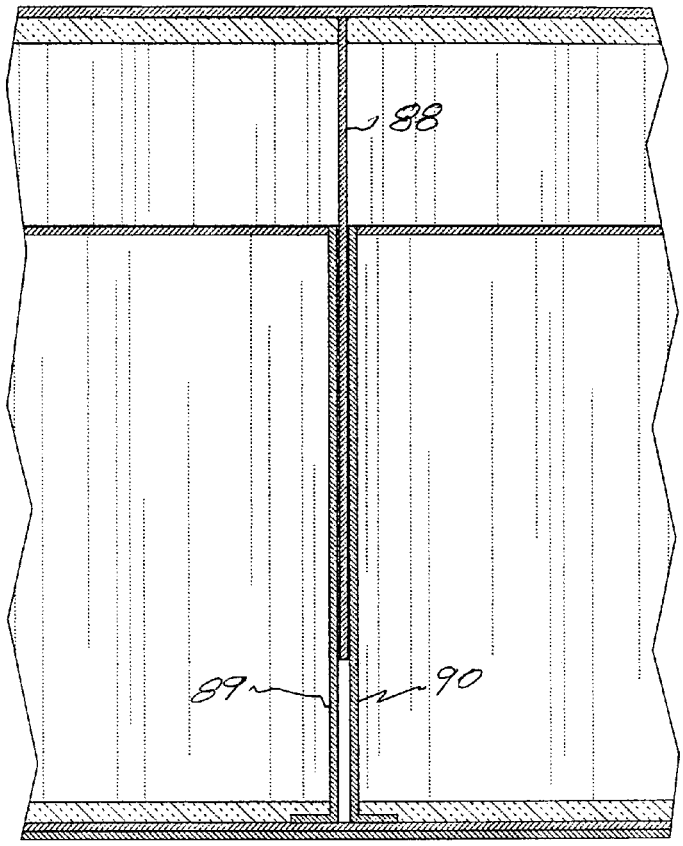
FIG. 15 is an enlarged vertical sectional view taken along the line 15-15 of FIG. 3.
Figure 16:
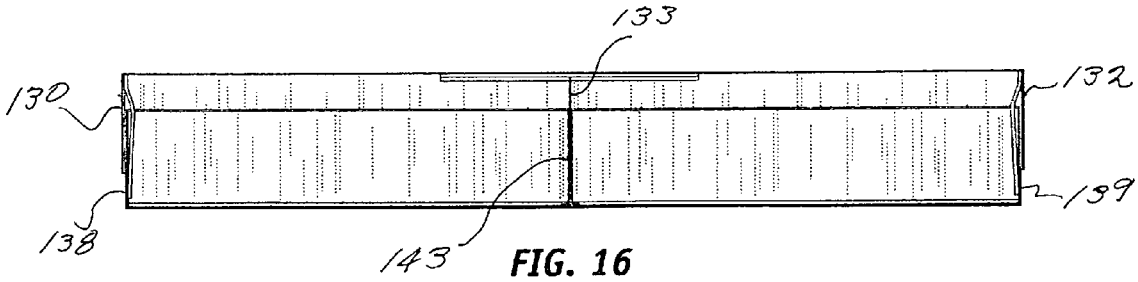
FIG. 16 is an enlarged vertical sectional view taken along the line 16-16 of FIG. 14.

When first element 125 is coupled with second element 127 to provide plenum assembly 124, intermediate panel 133 of first element 125 is received with intermediate panel 143 of second element 127 as illustrated in FIG. 16 and previously described in connection with plenum assembly 34 with reference to FIG. 15. In the assembled configuration, first element 125 is reciprocally movable relative second element 127 as denoted by the double arrowed, arcuate line G in FIG. 14.

Figure 17:
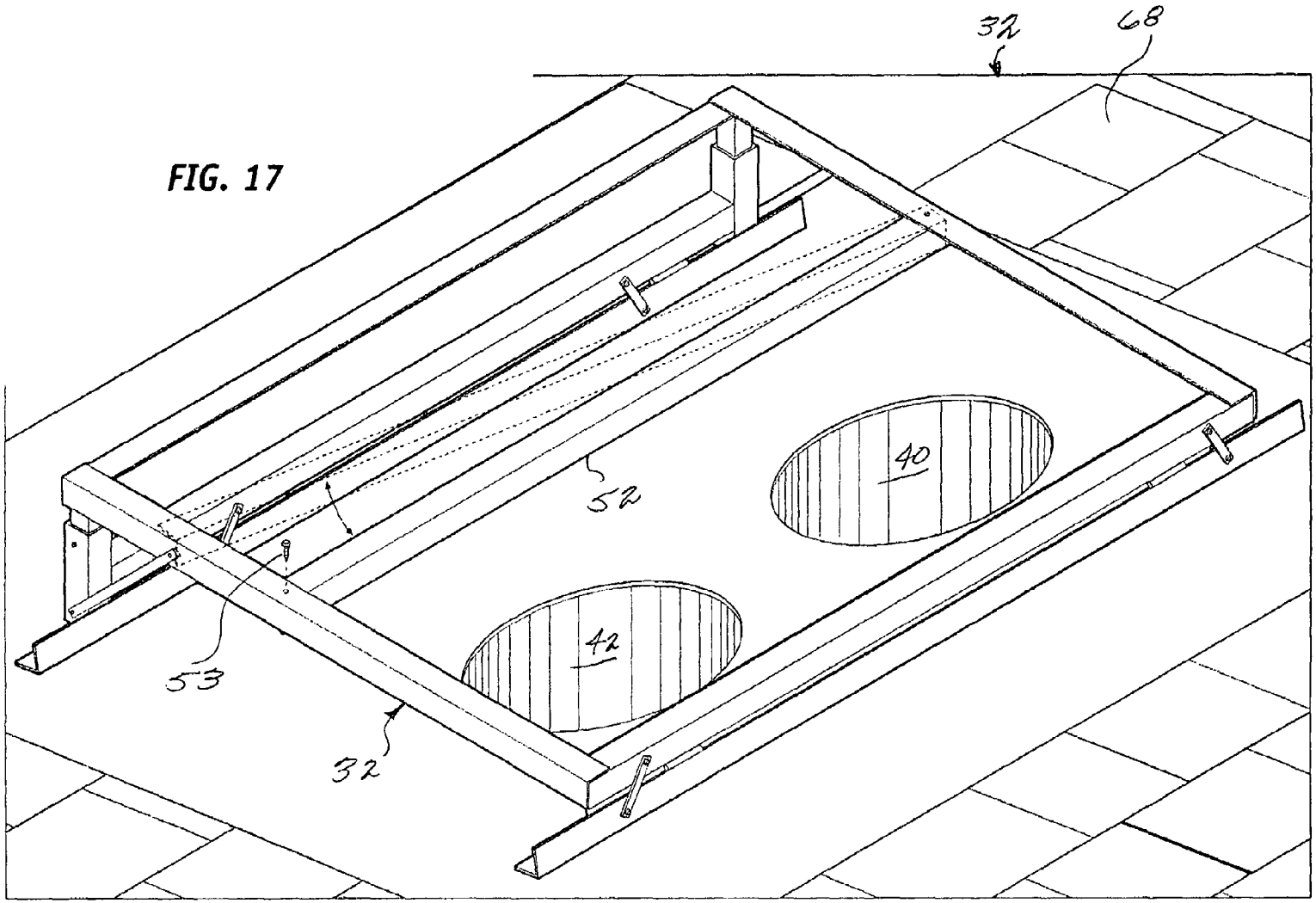
FIG. 17 is an enlarged perspective view of the framework seen in FIG. 11.
Figure 18:
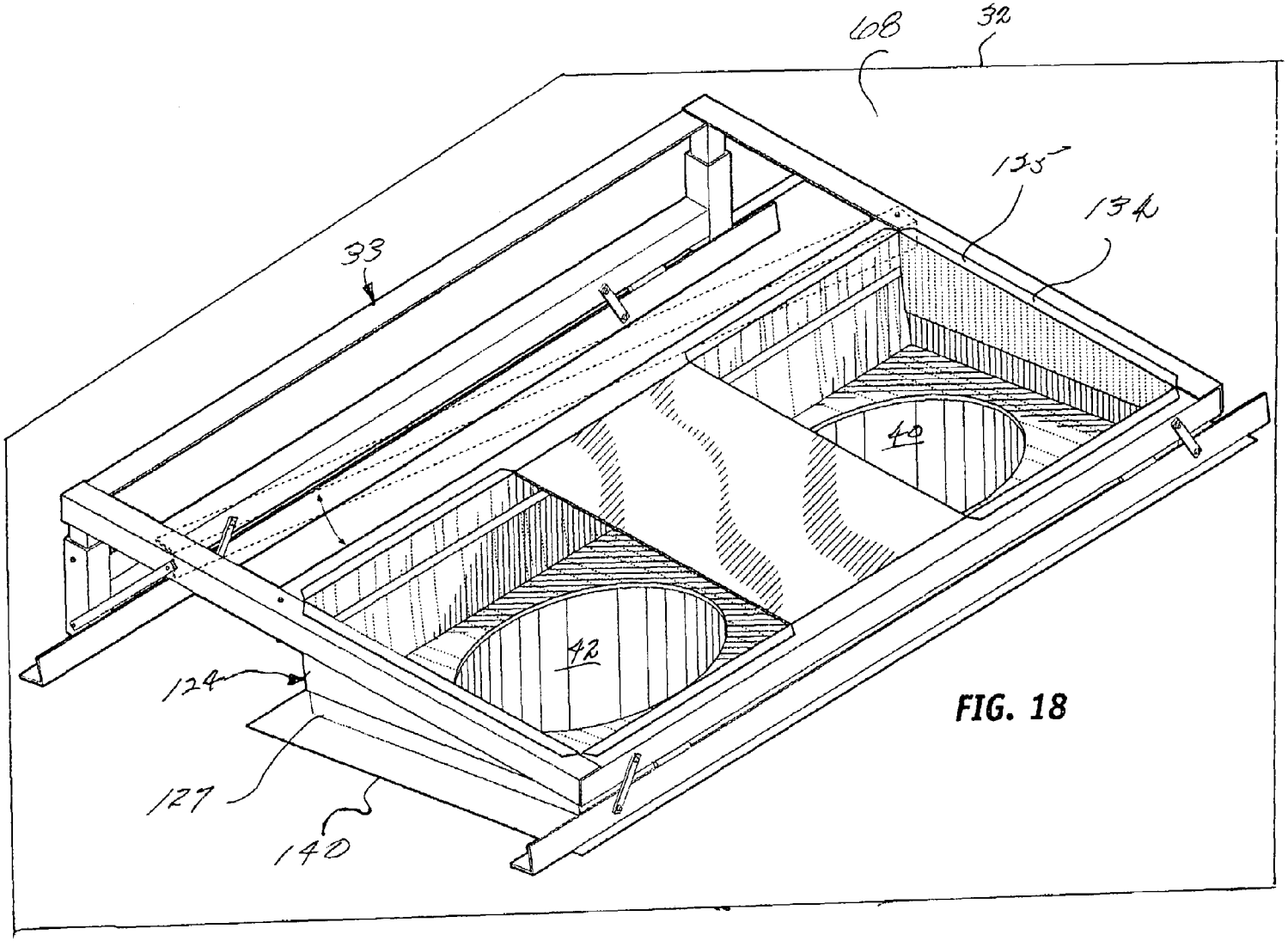
FIG. 18 is a view generally similar to the view of FIG. 17, as it would appear with the plenum installed.
Figure 19:
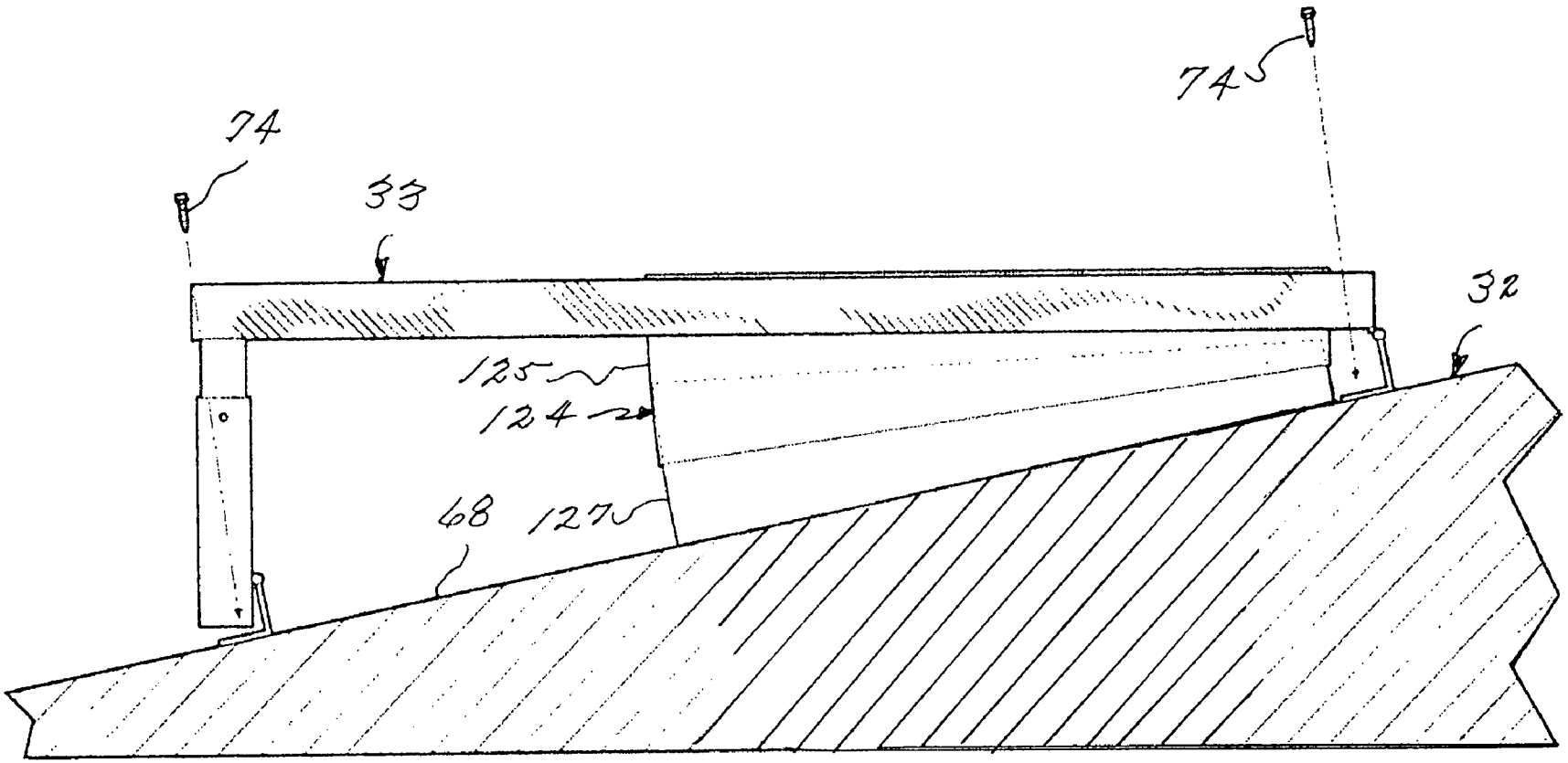
FIG. 19 is a side elevational view taken from the view of FIG. 18.
Figure 20:
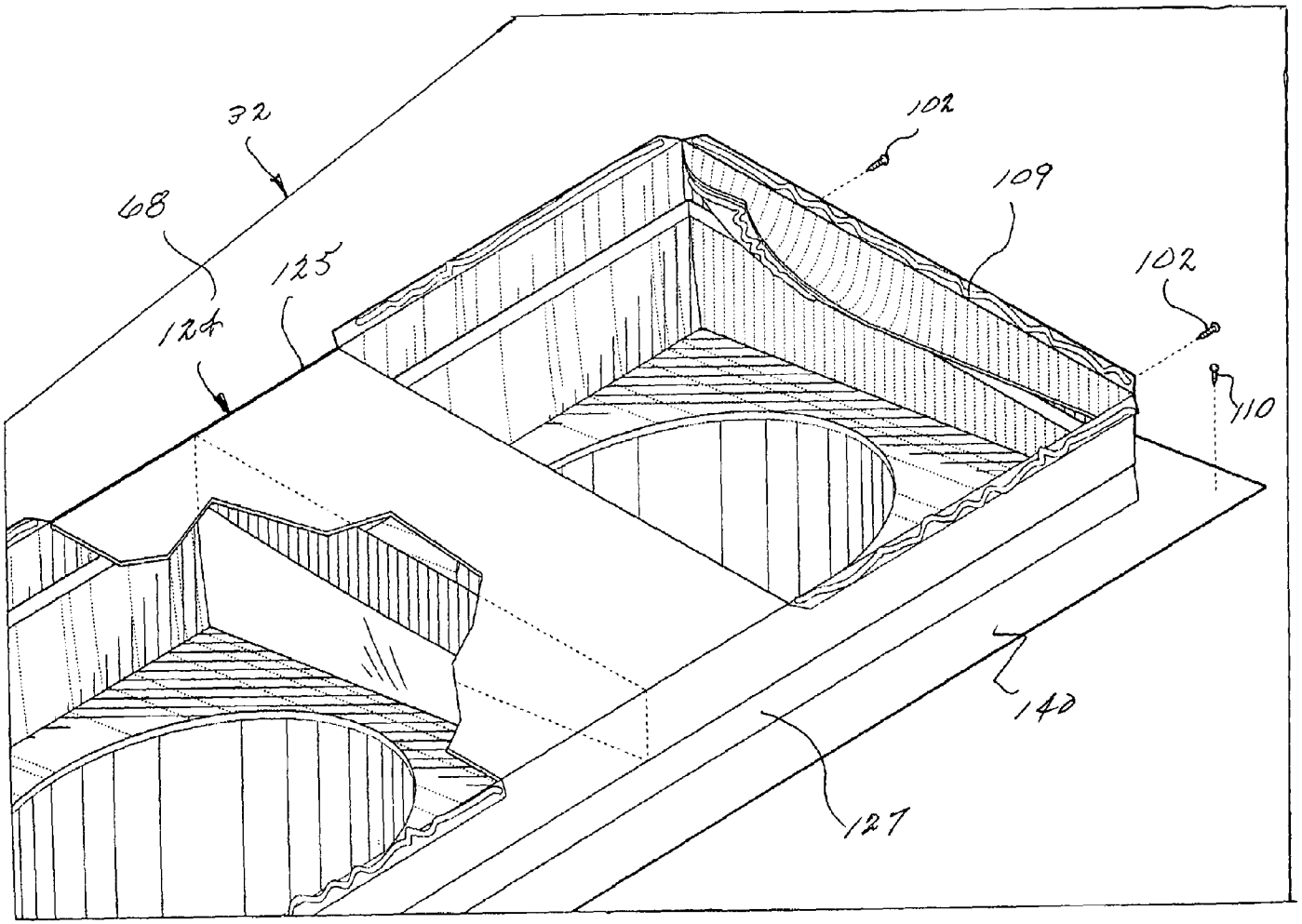
FIG. 20 is an enlarged, partial perspective view corresponding to the view of FIG. 13.

Reference is now made to FIG. 17, wherein frame 32 is illustrated in the adjusted condition and attached to surface 68 of roof 32. It is noted that temporary removal of reinforcement member 52 may be necessary for placement of 124 when in the adjusted condition as viewed in FIGS. 18 and 19.

As previously described in detail in connection with plenum assembly 34, screws 102 are employed to retain plenum assembly 124 in the adjusted condition. Screws 118 are passed through flange 140 and engaged with roof 32 to retain plenum assembly 124 in position upon roof 32. It is also noted that insulation panels are adhered to the interior surfaces of plenum assembly 124, as previously described in detail in connect with plenum assembly 34.

Figure 21:
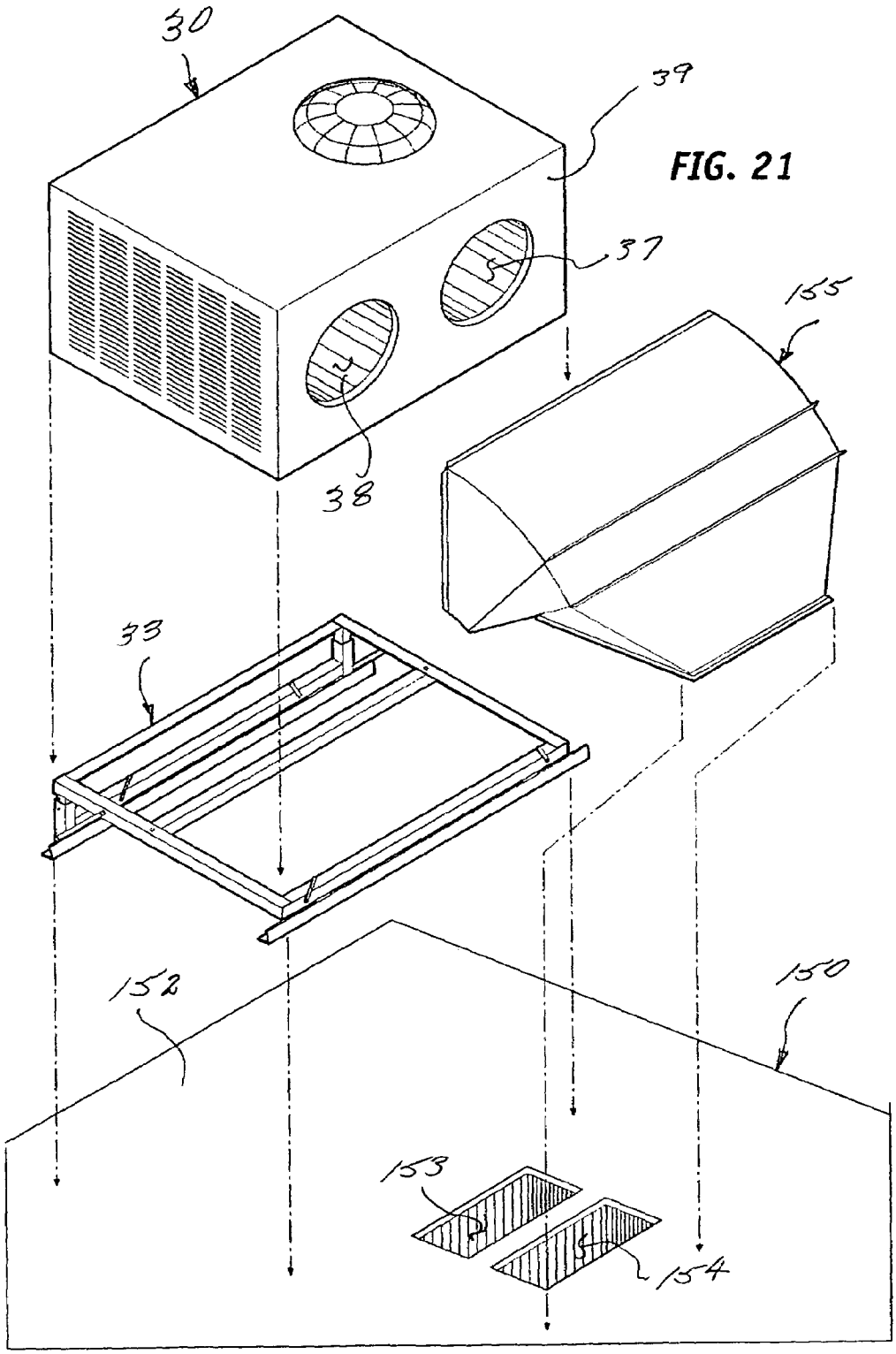
FIG. 21 is an exploded perspective view illustrating yet another embodiment of the instant invention.
Figure 22:
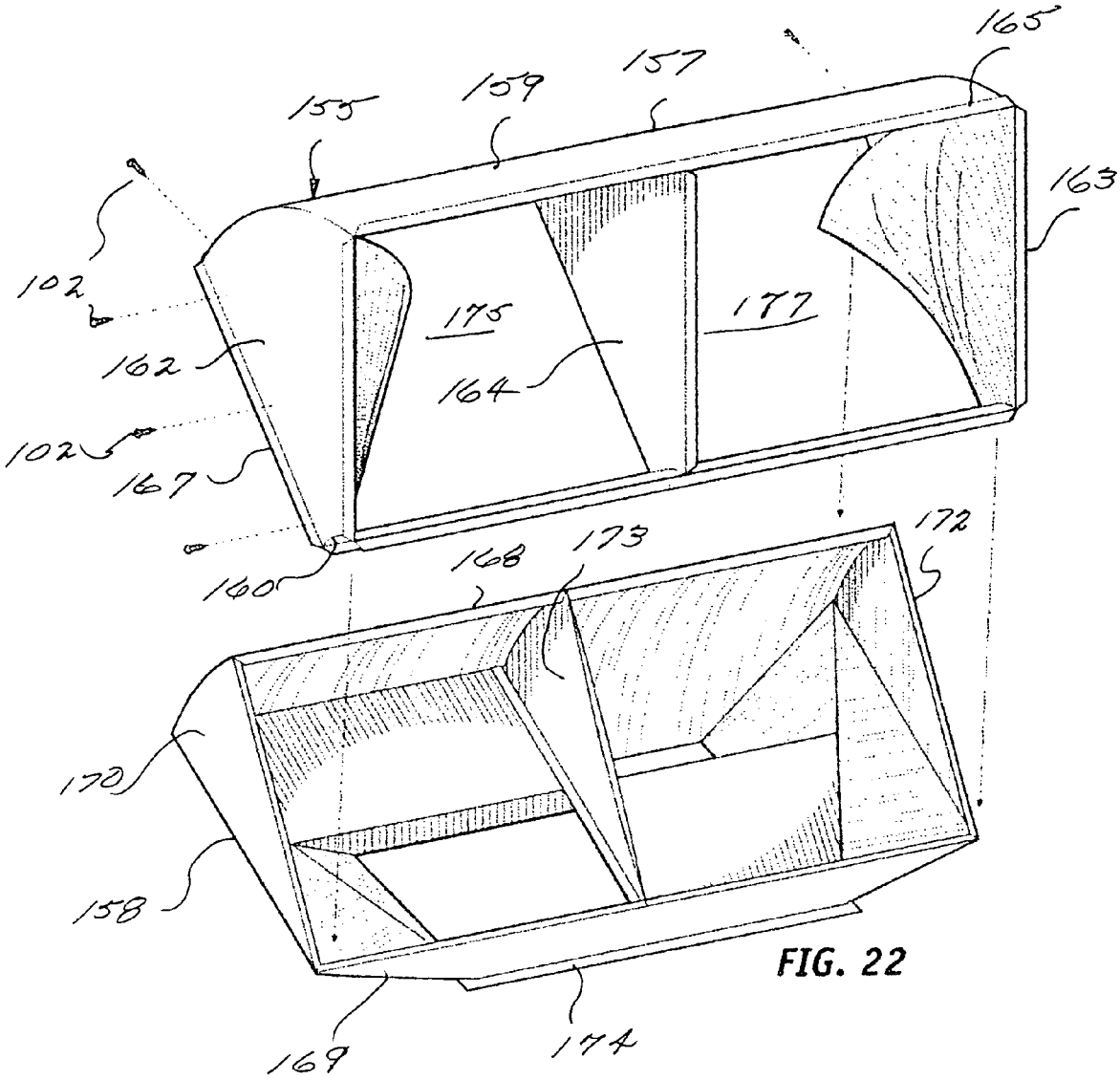
FIG. 22 is an enlarged, exploded perspective view of the plenum illustrated in FIG. 21.
Figure 23:
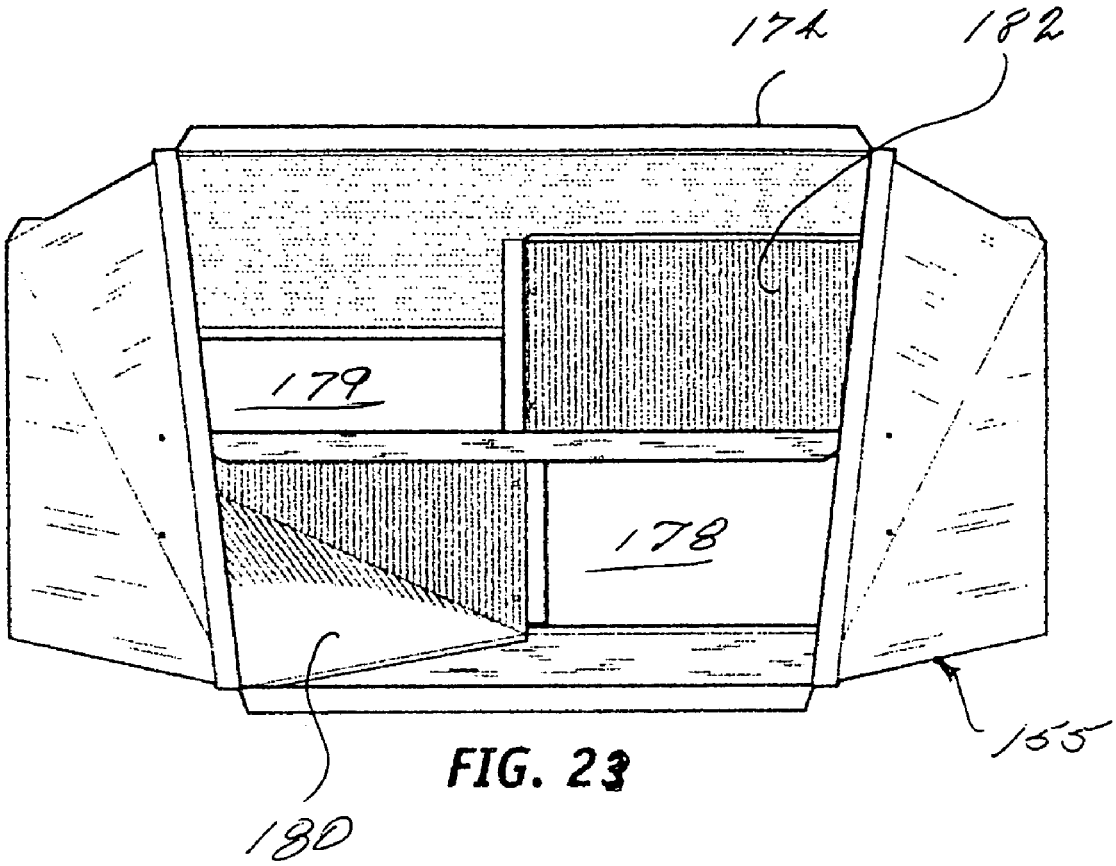
FIG. 23 is a bottom plan view of the plenum illustrated in FIG. 21.

Attention is now directed to FIGS. 21, 22 and 23 in which is illustrated an alternate embodiment fabricated in accordance with the principles of the instant invention. Referring first to FIG. 21, there is seen a roof 150 having sloping surface 152. Formed into surface are air exchange openings 153 and 154. In the previously described embodiments, the air exchange openings generally circular and aligned along a line substantially parallel to the lower edge of the roof. In the immediate embodiment, the openings 153 and 154 are generally rectangular and aligned along a line generally perpendicular to the edge of the roof.

The present embodiment of the installation incorporates air conditioning unit 30 and framework 33 as previously described in detail. For air communication between opening 37 in air conditioning unit 30 and opening 153 in roof 150 and for communication between opening 38 in air conditioning unit 30 and opening 154 in roof 150, required is an alternate plenum, generally designated by the reference character 155.

As seen in FIG. 22, plenum 155, in general similarity to previously illustrated and described plenums 34 and 124, comprises a first element 157 and a second element 150. First plenum element 157 includes outer panel 159, inner panel 160, end panel 162, end panel 163 and intermediate panel 164. Outer panel 159 and inner panel 160, in general similarity to the previously described corresponding panels, are generally arcuate in cross section while panels 163, 163 and 164 are generally planer. Upper outwardly directed parametric flange 165 and lower outwardly directed parametric flange 167, in further similarity to the previously described flanges 92 and 93, impart rigidity to the element.

Second plenum element 158 includes outer panel 168, inner panel 169, end panel 170, end panel 172 and intermediate panel 173. Plenum element 158 further includes parametric flange 174 extending outwardly from the lower edge.

In the assembled configuration, plenum 155 presents two chambers. First chamber 175 conducts air from opening 37 in air conditioning unit 32 to a first lower opening 178 in second plenum element 158 as seen with further reference to FIG. 23. Similarly, second chamber 177 communicates between opening 38 in air conditioning unit 32 and a second lower opening 179 in second plenum element 158. Panel assembly 180 in chamber 175 blocks air from outlet 27 and directs air to the respective opening. Panel assembly 182 similarly directs air to lower opening 178. Upon installation of plenum 155 intermediate roof surface 152 and sidewall 39 of air conditioning unit 32, opening 178 of plenum 155 encompasses opening 153 for passage of air therebetween. Similarly, opening 179 of plenum 155 communicates with opening 154 in roof 150. It can be seen, therefore, that plenum assembly 155 converts an over-and-under air flow at the roof to a side-by-side air flow at the air-conditioning unit.

In all other aspects, plenum assembly 155 is similar to the previously described plenum assemblies. For example, the interior of plenum 155 is lined with insulation. The plenum assembly is similarly adjusted and installed.

It will be readily understood by those skilled in the art that disclosed herein are new, improved, and useful installations of an air conditioning unit, plenum assemblies, an adjustable framework for use in an installation of an air conditioning unit, and associated methods of installing an air conditioning unit. The invention eliminates the need for maintaining an inventory of fixed-angle frames and fixed-angle plenums, eliminates the need for having to custom build specialized fixed-angle frames and fixed-angle plenums, and dramatically increases the speed and efficiency of installing roof-mounted air conditioning units.

The present invention is described above with reference to preferred embodiments. However, those skilled in the art will recognize that changes and modifications may be made in the described embodiment without departing from the spirit and scope of the present invention. For instance, while the illustration and description are directed to an air conditioning unit of the refrigeration or heating type having two air exchanges openings, it will be readily understood that the principles can be used for the installation of an evaporative unit have only one opening, and an air outlet.

Various further changes and modifications to the embodiment herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. In an air conditioning unit having an air exchange opening therein, and a surface having a slope and an air exchange opening therein, a method comprising steps of;

providing an adjustable framework adapted to be positioned upon the surface, the framework having a platform, a first frame, and a second frame coupled to the first frame for movement between a first position toward the first frame and a second position away from the first frame;

adjusting the adjustable framework by moving the second frame one of away from the first frame and toward the first frame to define a generally horizontal condition of the platform relative to the slope when the adjustable framework is positioned upon the surface;

securing the adjustable framework to form an adjusted framework;

positioning and securing the adjusted framework upon the sloping surface;

placing the air conditioning unit upon the platform; and coupling the opening in the air conditioning unit to the opening in the sloping surface;

wherein the step of positioning and securing the adjusted framework upon the sloping surface comprises:

pivotally attaching a first foot, having a sole, to the first frame;

pivotally attaching a second foot, having a sole, to the second frame;

presenting the first foot and the second foot upon the surface;

pivotally adjusting the first foot and the second foot so as to present the soles thereof against the surface;

securing the first foot to the surface; and securing the second foot to the surface;

wherein the step of coupling the opening in the air conditioning unit to the opening in the sloping surface comprises:

providing a plenum assembly comprising a first rigid plenum element, having an attachment end, coupled to a second rigid plenum element, having an attachment end, for movement between a first position toward the second rigid plenum element defining a retracted condition of the plenum assembly and a second position away from the second rigid plenum element defining an expanded condition of the plenum assembly;

adjusting the plenum assembly between its retracted and expanded conditions so as to place the plenum assembly in an adjusted condition;

the adjusted condition comprising the attachment ends of the first and second rigid plenum elements positionable concurrently against the air conditioning unit and the surface so as to engulf the openings therein, respectively;

rigidly securing the first rigid plenum element to the second rigid plenum element in the adjusted condition forming an adjusted plenum assembly;

coupling the attachment end of the first rigid plenum element to the air conditioning unit so as to engulf the opening therein; and coupling the attachment end of the second rigid plenum element to the surface so as to engulf the opening therein;

the plenum assembly providing concurrent communication with the opening in the air conditioning unit and the opening in the surface.

2. The method of claim 1, wherein the step of adjusting comprises:

determining a pitch of the slope; and adjusting the adjustable framework to define the generally horizontal condition of the platform relative to the slope when the adjustable framework is positioned upon the surface.

3. The method of claim 1, wherein the step of adjusting comprises:

positioning the adjustable framework upon the surface; and adjusting the adjustable framework adjusting the adjustable framework to define the generally horizontal condition of the platform relative to the slope when the adjustable framework is positioned upon the surface.

4. The method of claim 1, wherein the step of providing an adjustable framework comprises:

providing a first frame having a seat;

providing a second frame; and coupling the second frame to the first frame for movement between a first position toward the first frame and a second position away from the first frame.

5. The method of claim 4, wherein the step of adjusting the adjustable framework comprises moving the second frame one of away from the first frame and toward the first frame.

6. The method of claim 1, wherein the platform is carried by the first frame.

7. The method of claim 1, wherein the step of securing the adjustable framework comprises rigidly securing the first frame to the second frame.

8. The method of claim 5, wherein the step of positioning and securing the adjusted framework upon the sloping surface comprises:

pivotally attaching a first foot, having a sole, to the first frame;

pivotally attaching a second foot, having a sole, to the second frame;

presenting the first foot and the second foot upon the surface;

pivotally adjusting the first foot and the second foot so as to present the soles thereof against the surface;

securing the first foot to the surface; and securing the second foot to the surface.

9. The method of claim 1, wherein the step of coupling the opening in the air conditioning unit to the opening in the sloping surface comprises affixing a plenum for concurrent communication with the opening in the air conditioning unit and with the opening in the surface.

10. The method of claim 1, wherein the step of coupling the opening in the air conditioning unit to the opening in the sloping surface comprises:

providing an plenum assembly comprising a first rigid plenum element, having an attachment end, coupled to a second rigid plenum element, having an attachment end, for movement between a first position toward the first rigid plenum element defining a retracted condition of the plenum assembly and a second position away from the first rigid plenum element defining an expanded condition of the plenum assembly;

adjusting the plenum assembly between its retracted and expanded conditions so as to place the plenum assembly in an adjusted condition;

the adjusted condition comprising the attachment ends of the first and second rigid plenum elements positionable concurrently against the air conditioning unit and the surface so as to engulf the openings therein, respectively;

rigidly securing the first rigid plenum element to the second rigid plenum element in the adjusted condition forming an adjusted plenum assembly;

coupling the attachment end of the first rigid plenum element to the surface so as to engulf the opening therein; and coupling the attachment end of the second rigid plenum element to the surface so as to engulf the opening therein;

the plenum assembly providing concurrent communication with the opening in the air conditioning unit and the opening in the surface.

11. The method of claim 1, further comprising:

one of the first and second rigid plenum elements having at least one internally disposed insulating flap having an attached end and an opposing free end; and wherein the step of securing the first rigid plenum element to the second rigid plenum element further comprises securing the opposing end of the insulating flap internally to the other of the first and second rigid plenum elements.

12. The method of claim 1, wherein the step of coupling the opening in the air conditioning unit to the opening in the sloping surface comprises:

providing an plenum assembly comprising a first rigid plenum element, having an attachment end, coupled to a second rigid plenum element, having an attachment end, for movement between a first position toward the first rigid plenum element defining a retracted condition of the plenum assembly and a second position away from the first rigid plenum element defining an expanded condition of the plenum assembly;

presenting the attachment end the first rigid plenum element against the surface engulfing the opening therethrough;

adjusting the plenum assembly between its retracted and expanded conditions so as to place the attachment end of the second rigid plenum element against the surface engulfing the opening therein;

rigidly securing the first rigid plenum element to the second rigid plenum element forming an adjusted plenum assembly;

coupling the attachment end of the first rigid plenum element to the surface so as to engulf the opening therein; and coupling the attachment end of the second rigid plenum element to the surface so as to engulf the opening therein;

the plenum assembly providing concurrent communication with the opening in the air conditioning unit and the opening in the surface.

13. The method of claim 12, further comprising:

one of the first and second rigid plenum elements having at least one internally disposed insulting flap having an attached end and an opposing free end; and wherein the step of securing the first rigid plenum element to the second rigid plenum element further comprises securing the opposing end of the insulating flap internally to the other of the first and second rigid plenum elements.

14. In an air conditioning unit having an air exchange opening therein, and a surface having a slope and an air exchange opening therein, a method comprising steps of;

mounting the air conditioning unit to the surface adjacent the opening therethrough;

providing a plenum assembly comprising a first rigid plenum element, having an attachment end, coupled to a second rigid plenum element, having an attachment end, for movement between a first position toward the second rigid plenum element defining a retracted condition of the plenum assembly and a second position away from the second rigid plenum element defining an expanded condition of the plenum assembly;

adjusting the plenum assembly between its retracted and expanded conditions so as to place the plenum assembly in an adjusted condition;

the adjusted condition comprising the attachment ends of the first and second rigid plenum elements positionable concurrently against the air conditioning unit and the surface so as to engulf the openings therein, respectively;

rigidly securing the first rigid plenum element to the second rigid plenum element in the adjusted condition forming an adjusted plenum assembly;

coupling the attachment end of the first rigid plenum element to the air conditioning unit so as to engulf the opening therein; and coupling the attachment end of the second rigid plenum element to the surface so as to engulf the opening therein;

the plenum assembly providing concurrent communication with the opening in the air conditioning unit and the opening in the surface.

15. The method of claim 14, further comprising:

one of the first and second rigid plenum elements having at least one internally disposed insulating flap having an attached end and an opposing free end; and wherein the step of securing the first rigid plenum element to the second rigid plenum element further comprises securing the opposing end of the insulating flap internally to the other of the first and second rigid plenum elements.

16. The method of claim 14, wherein the step of mounting the air conditioning unit to the surface comprises:

providing an adjustable framework adapted to be positioned upon the surface, the framework having a platform;

adjusting the adjustable framework to define a generally horizontal condition of the platform relative to the slope when the adjustable framework is positioned upon the surface;

securing the adjustable framework to form an adjusted framework;

positioning and securing the adjusted framework upon the sloping surface;

placing the air conditioning unit upon the platform; and coupling the opening in the air conditioning unit to the opening in the sloping surface.

17. The method of claim 16, wherein the step of adjusting the adjustable framework comprises:

determining a pitch of the slope; and adjusting the adjustable framework to define the generally horizontal condition of the platform relative to the slope when the adjustable framework is positioned upon the surface.

18. The method of claim 16, wherein the step of adjusting the adjustable framework comprises:

positioning the adjustable framework upon the surface; and adjusting the adjustable framework adjusting the adjustable framework to define the generally horizontal condition of the platform relative to the slope when the adjustable framework is positioned upon the surface.

19. The method of claim 16, wherein the step of providing an adjustable framework comprises:

providing a first frame having a seat;

providing a second frame; and coupling the second frame to the first frame for movement between a first position toward the first frame and a second position away from the first frame.

20. The method of claim 19, wherein the step of adjusting the adjustable framework comprises moving the second frame one of away from the first frame and toward the first frame.

21. The method of claim 19, wherein the platform is carried by the first frame.

22. The method of claim 19, wherein the step of securing the adjustable framework comprises rigidly securing the first frame to the second frame.

23. The method of claim 19, wherein the step of positioning and securing the adjusted framework upon the sloping surface comprises:

pivotally attaching a first foot, having a sole, to the first frame;

pivotally attaching a second foot, having a sole, to the second frame;

presenting the first foot and the second foot upon the surface;

pivotally adjusting the first foot and the second foot so as to present the soles thereof against the surface;

securing the first foot to the surface; and securing the second foot to the surface.

24. In an air conditioning unit having an air exchange opening therein, and a surface having a slope and an air exchange opening therein, a method comprising steps of;

providing an adjustable framework adapted to be positioned upon the surface, the framework having a platform;

adjusting the adjustable framework to define a generally horizontal condition of the platform relative to the slope when the adjustable framework is positioned upon the surface;

securing the adjustable framework to form an adjusted framework;

positioning and securing the adjusted framework upon the sloping surface;

placing the air conditioning unit upon the platform; and coupling the opening in the air conditioning unit to the opening in the sloping surface;

wherein the step of coupling the opening in the air conditioning unit to the opening in the sloping surface comprises:

providing an plenum assembly comprising a first rigid plenum element, having a attachment end, coupled to a second rigid plenum element, having an attachment end, for movement between a first position toward the second rigid plenum element defining a retracted condition of the plenum assembly and a second position away from the second rigid plenum element defining an expanded condition of the plenum assembly;

adjusting the plenum assembly between its retracted and expanded conditions so as to place the plenum assembly in an adjusted condition;

the adjusted condition comprising the attachment ends of the first and second rigid plenum elements positionable concurrently against the air conditioning unit and the surface so as to engulf the openings therein, respectively;

rigidly securing the first rigid plenum element to the second rigid plenum element in the adjusted condition forming an adjusted plenum assembly;

coupling the attachment end of the first rigid plenum element to the air conditioning unit so as to engulf the opening therein; and coupling the attachment end of the second rigid plenum element to the surface so as to engulf the opening therein;

the plenum assembly providing concurrent communication with the opening in the air conditioning unit and the opening in the surface.

25. The method of claim 24, further comprising:

one of the first and second rigid plenum elements having at least one internally disposed insulating flap having an attached end and an opposing free end; and wherein the step of securing the first rigid plenum element to the second rigid plenum element further comprises securing the opposing end of the insulating flap internally to the other of the first and second rigid plenum elements.

26. The method of claim 24, wherein the step of coupling the opening in the air conditioning unit to the opening in the sloping surface comprises:

providing an plenum assembly comprising a first rigid plenum element, having an attachment end, coupled to a second rigid plenum element, having an attachment end, for movement between a first position toward the second rigid plenum element defining a retracted condition of the plenum assembly and a second position away from the second rigid plenum element defining an expanded condition of the plenum assembly;

presenting the attachment end the first rigid plenum element against the air conditioning unit engulfing the opening therethrough;

adjusting the plenum assembly between its retracted and expanded conditions so as to place the attachment end of the second rigid plenum element against the surface engulfing the opening therein;

rigidly securing the first rigid plenum element to the second rigid plenum element forming an adjusted plenum assembly;

coupling the attachment end of the first rigid plenum element to the air conditioning unit so as to engulf the opening therein; and coupling the attachment end of the second rigid plenum element to the surface so as to engulf the opening therein;

the plenum assembly providing concurrent communication with the opening in the air conditioning unit and the opening in the surface.

27. The method of claim 26, further comprising:

one of the first and second rigid plenum elements having at least one internally disposed insulating flap having an attached end and an opposing free end; and wherein the step of securing the first rigid plenum element to the second rigid plenum element further comprises securing the opposing end of the insulating flap internally to the other of the first and second rigid plenum elements.

28. The method of claim 24, wherein the step of adjusting comprises:

determining a pitch of the slope; and adjusting the adjustable framework to define the generally horizontal condition of the platform relative to the slope when the adjustable framework is positioned upon the surface.

29. The method of claim 24, wherein the step of adjusting comprises:

positioning the adjustable framework upon the surface; and adjusting the adjustable framework adjusting the adjustable framework to define the generally horizontal condition of the platform relative to the slope when the adjustable framework is positioned upon the surface.

30. The method of claim 24, wherein the step of providing an adjustable framework comprises:

providing a first frame having a seat;

providing a second frame; and coupling the second frame to the first frame for movement between a first position toward the first frame and a second position away from the first frame.

31. The method of claim 30, wherein the step of adjusting the adjustable framework comprises moving the second frame one of away from the first frame and toward the first frame.

32. The method of claim 31, wherein the platform is carried by the first frame.

33. The method of claim 31, wherein the step of securing the adjustable framework comprises rigidly securing the first frame to the second frame.

34. The method of claim 31, wherein the step of positioning and securing the adjusted framework upon the sloping surface comprises:

pivotally attaching a first foot, having a sole, to the first frame;

pivotally attaching a second foot, having a sole, to the second frame;

presenting the first foot and the second foot upon the surface;

pivotally adjusting the first foot and the second foot so as to present the soles thereof against the surface;

securing the first foot to the surface; and securing the second foot to the surface.

35. The method of claim 24, wherein the step of coupling the opening in the air conditioning unit to the opening in the sloping surface comprises affixing a plenum for concurrent communication with the opening in the air conditioning unit and with the opening in the surface.

* * * * *